US011021310B2

(12) United States Patent
Nelson

(10) Patent No.: US 11,021,310 B2
(45) Date of Patent: Jun. 1, 2021

(54) SYSTEM SUPPORTING FILLING AND HANDLING BULK BAG APPARATUS CONTAINING TORREFIED MATERIALS

(71) Applicant: Thomas M. Nelson, Chagrin Falls, OH (US)

(72) Inventor: Thomas M. Nelson, Chagrin Falls, OH (US)

(73) Assignee: Torresak LLC, Chagrin Falls, OH (US)

( * ) Notice: Subject to any disclaimer, the term of this patent is extended or adjusted under 35 U.S.C. 154(b) by 182 days.

(21) Appl. No.: 16/293,353

(22) Filed: Mar. 5, 2019

(65) Prior Publication Data

US 2019/0375572 A1 Dec. 12, 2019

Related U.S. Application Data

(60) Provisional application No. 62/638,708, filed on Mar. 5, 2018.

(51) Int. Cl.

| | |
|---|---|
| ***B65D 88/16*** | (2006.01) |
| ***B65D 81/20*** | (2006.01) |
| ***B65B 7/02*** | (2006.01) |
| ***B65D 88/72*** | (2006.01) |
| *B65D 90/46* | (2006.01) |

(52) U.S. Cl.

CPC ..... *B65D 81/2023* (2013.01); *B65B 7/02* (2013.01); *B65D 88/165* (2013.01); *B65D 88/1606* (2013.01); *B65D 88/1631* (2013.01); *B65D 88/72* (2013.01); *B65D 90/46* (2013.01)

(58) Field of Classification Search

CPC ..... B65D 88/1606; B65D 88/1618; B65D 88/1625; B65D 88/1631; B65D 88/1637; B65D 81/2023; B65D 88/1612; B65D 5/4212; B65D 81/20; B65D 81/18

USPC ..... 206/459.1

See application file for complete search history.

(56) References Cited

U.S. PATENT DOCUMENTS

| | | | | |
|---|---|---|---|---|
| 7,509,839 | B2 * | 3/2009 | Duranton | A45D 33/26 206/581 |
| 2007/0065546 | A1 * | 3/2007 | Jorgensen | A23B 7/148 426/316 |
| 2010/0192998 | A1 * | 8/2010 | Villers | B65D 88/54 135/96 |

(Continued)

*Primary Examiner* — Steven A. Reynolds

(74) *Attorney, Agent, or Firm* — Mueller Law, LLC; Jerry K. Mueller, Jr.

(57) ABSTRACT

A container includes a multilayered composite film combination forming a bag defining a product fill opening. The multilayered composite film combination includes first and second polymer film inner and outer layers each having vacuum holding properties, and a third polymer film disposed between the first and second polymer films. The third polymer film has oxygen barrier properties. Product is packed into the container by coupling a fill spout of the container with a fill tube of a product filling apparatus, and oxygen is drawn from an inner cavity of the container. Fluidized product entrained in nitrogen and/or carbon dioxide gas is flowed through the fill spout of the container, and nitrogen is added into the inner cavity through the fill spout of the container. The fill spout of the container is sealed while a negative pressure is drawn within the inner cavity thereby immobilizing the product within the container.

20 Claims, 14 Drawing Sheets

(56) References Cited

U.S. PATENT DOCUMENTS

| | | | | |
|---|---|---|---|---|
| 2011/0085748 | A1* | 4/2011 | Turvey | B65D 81/2023 383/100 |
| 2011/0311165 | A1* | 12/2011 | Lommerts | B65D 88/1687 383/6 |
| 2013/0168391 | A1* | 7/2013 | Hunter | B65D 90/0066 220/7 |
| 2014/0270595 | A1 | 9/2014 | Holdstock | |
| 2016/0075461 | A1* | 3/2016 | Roozen | B65B 29/00 53/428 |
| 2016/0361232 | A1* | 12/2016 | Chou | B65D 1/09 |
| 2017/0001796 | A1* | 1/2017 | Nelson | B32B 7/04 |

* cited by examiner

SYSTEM SUPPORTING FILLING AND HANDLING BULK BAG APPARATUS CONTAINING TORREFIED MATERIALS

CROSS REFERENCE TO RELATED APPLICATION

This application claims benefit of priority to U.S. Provisional Patent application Ser. No. 62/638,708, filed on Mar. 5, 2018, the disclosure of which is incorporated herein by reference in its entirety.

TECHNICAL FIELD

The embodiments herein relate generally to containers and to methods of filling containers for storage and transportation of solid filled products in powder, granule or chip form, in the form of pieces or in any form convenient for filling, storage and shipping, and more specifically to containers and to methods of filling containers for storage and transportation of solid filled torrefied materials in any form as may be necessary or desired for convenient and efficient filling, shipping and storage. The example embodiments herein will be described in connection with a big bulk bag such as for example a flexible intermediate bulk container (FIBC). However, it is to be appreciated that the embodiments are not limited to these applications, but also find use in many other applications including for example bulk packaging for perishable dry foods, spices, chemicals and other materials in solid form.

BACKGROUND

Torrefied or pyrolized biomass is the product of a new and emerging market. Torrefied biomass has many uses in the energy, agricultural, chemical and construction industries. This new carbonized material has, in certain conditions, a calorific energy value similar to coal. Indeed, one of the principal applications for torrefied biomass is "biocoal," which is a more environmentally friendly fuel for generating electricity.

When biomass is torrefied (heated at 500 C to 600 C in the absence of oxygen), volatile elements of the biomass are vaporized. As the material cools, some of these vaporized volatiles condense back onto the surface of the char. This new carbonized material is highly flammable and explosive. Under certain conditions, these condensed volatiles can self-ignite. In addition, grinding the torrefied biomass during processing thereof can act as an accelerant to this pyrophoric reaction. It is also possible that static electric discharge (sparking) could function as an igniter. It is further possible that friction caused by vibration of the char during processing, handling or transport could function as an igniter.

Given the above, therefore, transporting and storing of torrefied materials such as biomass or other fuels presents risks including for example, possible risk of fire and/or explosions.

It became clear by 2013 that the nascent torrefaction industry needs to develop new safety protocols, products and procedures to help reduce the risk of fire and explosion associated with the handling, storage and transportation of torrefied biomass.

A flexible intermediate bulk container (FIBC) or bulk bag, or big bag, is an industrial container made of flexible fabric that is designed for storing and transporting dry, flowable products, such as sand, fertilizer, and granules of plastic. FIBC bulk bags are available in various standardized configurations including Types A-D FIBC bulk bags and are compatible for use with virtually any free-flowing granule, powder, pellet or flake.

The current package of choice for the torrefaction industry is merely a regular Type A bulk sack, which is made from plain woven polypropylene or polyethylene fibers. There are no safety features inherent to the Type B bulk sack, as the fibers present no significant barrier to $O_2$ or $H_2O$ transfer, and there is no provision for static discharge or friction. Type C bulk sacks are conductive as they are in general constructed from electrically conductive fabric, designed to control electrostatic charges by grounding using integral conductive threads or tape, but they lack impermeable barrier properties to prevent the transfer of gasses, moisture and/or other vapors. Lastly, industry standard Type D FIBC bulk bags have anti-static or static dissipative properties without the requirement of grounding, but they are also deficient in providing impermeable barrier properties to prevent the transfer of gasses, moisture and/or other vapors It is therefore desirable to provide a container for the safe bulk storage and transport of hazardous dry flowable products such as torrefied materials without these limitations and to a method and equipment for filling such container. In particular, a container that provides a modified atmosphere environment to help reduce the risk of fire and explosion inherent to the transport and storage of torrefied biomass is desirable. A bulk bag container that provides a significant barrier to $O_2$ and $H_2O$ transfer is desirable. Further, a bulk bag container that provides for static discharge is desirable. Yet still further, a bulk bag container that substantially controls the movement of the torrefied materials within the bulk bag is desirable. Yet still further, a bulk bag container that provides for a visual verification of the modified atmosphere environment within the bag for helping to reduce the risk of fire and explosion inherent to the transport and storage of torrefied biomass is desirable. It is further desirable to provide systems and methods for easily, efficiently, and safely filling such containers with torrefied or other hazardous materials.

BRIEF SUMMARY OF EXAMPLE EMBODIMENTS

Example embodiments herein relate to a bulk bag apparatus for safe storage and transport of torrefied materials, and to a method for filling the bulk bag apparatus.

In accordance with an example embodiment herein, a bulk container presents a unique and innovative use of Modified Atmosphere Packaging (MAP) design and construction to help reduce the risk of fire and explosion inherent to the transport and storage of torrefied biomass.

In accordance with an example embodiment herein, a container is provided for receiving and holding associated filled product. In an exemplar embodiment, the container includes a multilayered composite film combination forming a bag defining a product fill opening. The multilayered composite film combination includes an inner layer first polymer film having vacuum holding properties, an outer layer second polymer film having vacuum holding properties, and a third polymer film disposed between the first and second polymer films, wherein the third polymer film has oxygen barrier properties. In an embodiment the first polymer film is a first low density polyethylene (LDPE) film, the second polymer film is a second LDPE film, and the third polymer film is an ethylene-vinyl acetate (EVA) film. The first and second LDPE films provide an airtight vacuum seal. The EVA film is impervious to flows of oxygen and nitrogen therethrough.

In accordance with a further example embodiment, an apparatus for receiving and holding associated filled product is provided, wherein the apparatus includes an in-liner container comprising one or more side members and a bottom member define an inner space of the in-liner container for receiving and holding the associated filled product, and a multilayered composite film combination forming a bag defining a product fill opening; and sensor device disposed in the inner space of the in-liner container. The multilayered composite film combination of the example embodiment comprises a first polymer film having vacuum holding properties, the first polymer film acting as an inner layer of the in-liner container, a second polymer film having vacuum holding properties, the second polymer film acting as an outer layer of the in-liner container, and a third polymer film disposed between the first and second polymer films, the third polymer film having oxygen barrier properties. The sensor device senses a level of a chemical in the inner space of the in-liner container and generates a signal representative of the sensed level of the chemical. In one form the sensor device comprises an oxygen sensor device sensing a concentration of oxygen in the inner space of the in-liner container and generating a signal representative of the sensed concentration of oxygen. In a further form the oxygen sensor device generates a color signal representative of the sensed concentration of oxygen. In a still further form, the oxygen sensor device comprises an adhesive attaching the oxygen sensor device with the multilayered composite film combination in the inner space of the in-liner container.

In accordance with a further example embodiment, a composite bulk storage and transport apparatus includes a flexible intermediate bulk container (FIBC) container and an in-liner container received in the FIBC container, the in-liner container receiving and holding associated filled product. The in-liner container is operatively coupled with the FIBC container such as for example be being received in the FIBC container, and includes a multilayered composite film combination forming a bag defining a product fill opening. The multilayered composite film combination includes a first polymer film having vacuum holding properties, the first polymer film acting as an inner layer of the in-liner container; a second polymer film having vacuum holding properties, the second polymer film acting as an outer layer of the in-liner container; and a third polymer film disposed between the first and second polymer films, the third polymer film having oxygen barrier properties.

In accordance with a further example embodiment, a composite bulk storage and transport apparatus includes a flexible intermediate bulk container (FIBC) device defining an aperture, an in-liner container received in an inner space of the FIBC device, and a sensor device disposed in an inner space of the in-liner container located adjacent to the aperture defined in the FIBC device for viewing of the sensor device through the aperture defined in the FIBC device and also through the clear or otherwise transparent material of the in-liner container. The FIBC device comprises one or more side members and a bottom member, wherein the one or more side members and the bottom member of the FIBC device define an inner space of the FIBC device. In addition and in accordance with the example embodiment, the one or more side members define at least one aperture for allowing access to the inner space of the FIBC device through the one or more side members defining the at least one aperture. The in-liner container of the example embodiment comprises one or more side members and a bottom member, the one or more side members and the bottom member of the in-liner container define an inner space of the in-liner container for receiving and holding an associated filled product. The in-liner container is received in the inner space of the FIBC device and comprises a clear or otherwise transparent multilayered composite film combination forming a bag defining a product fill opening. The multilayered composite film combination comprises a first polymer film having vacuum holding properties wherein the first polymer film acts as an inner layer of the in-liner container, a second polymer film having vacuum holding properties wherein the second polymer film acts as an outer layer of the in-liner container, and a third polymer film disposed between the first and second polymer films wherein the third polymer film has oxygen barrier properties. In the example embodiment, the sensor device includes an adhesive for attaching it to the inner surface of the in-liner bag whereby the sensor device senses a level of a chemical in the inner space of the in-liner container and generates a signal representative of the sensed level of the chemical. In one form, the sensor device comprises an oxygen sensor device sensing a concentration of oxygen in the inner space of the in-liner container and generating a signal representative of the sensed concentration of oxygen. In a further form, the oxygen sensor device generates a color signal representative of the sensed concentration of oxygen.

In a further form of an example embodiment, the one or more side members of the FIBC device comprise front and back panels and left and right gussets that together with the bottom member define the inner space of the FIBC device. A first elongate vertical aperture is defined between the back panel and the left gusset, a second elongate vertical aperture is defined between the left gusset and the front panel, a third elongate vertical aperture is defined between the front panel and the right gusset, and a fourth elongate vertical aperture is defined between the right gusset and the back panel. A first oxygen sensor device is disposed in the inner space of the in-liner and located adjacent to the first elongate vertical aperture, wherein the first oxygen sensor senses a concentration of oxygen in the inner space of the in-liner container near to the first sensor and generates a first color signal representative of the sensed concentration of oxygen in the inner space of the in-liner container near to the first sensor. A second oxygen sensor device is disposed in the inner space of the in-liner and located adjacent to the second elongate vertical aperture, wherein the second oxygen sensor senses a concentration of oxygen in the inner space of the in-liner container near to the second sensor and generates a second color signal representative of the sensed concentration of oxygen in the inner space of the in-liner container near to the second sensor. A third oxygen sensor device is disposed in the inner space of the in-liner and located adjacent to the third elongate vertical aperture, wherein the third oxygen sensor senses a concentration of oxygen in the inner space of the in-liner container near to the third sensor and generates a third color signal representative of the sensed concentration of oxygen in the inner space of the in-liner container near to the third sensor. A fourth oxygen sensor device is disposed in the inner space of the in-liner and located adjacent to the fourth elongate vertical aperture, wherein the fourth oxygen sensor senses a concentration of oxygen in the inner space of the in-liner container near to the fourth sensor and generates a fourth color signal representative of the sensed concentration of oxygen in the inner space of the in-liner container near to the fourth sensor.

In a further form of an example embodiment, the one or more side members of the FIBC device comprise front and back panels and left and right gussets that together with the bottom member define the inner space of the FIBC device. A first elongate vertical aperture is defined between the back panel and the left gusset, a second elongate vertical aperture is defined between the left gusset and the front panel, a third elongate vertical aperture is defined between the front panel and the right gusset, and a fourth elongate vertical aperture is defined between the right gusset and the back panel. In the example embodiment, the FIBC device comprises a first fastener system for selectively closing the first elongate vertical aperture and tightening the back panel with the left gusset, a second fastener system for selectively closing the second elongate vertical aperture defined between the left gusset and the front panel, a third fastener system for selectively closing the third elongate vertical aperture and tightening the front panel with the right gusset, and a fourth fastener system for selectively closing the fourth elongate vertical aperture and tightening the right gusset with the back panel.

In accordance with yet a further example embodiment, a method of packing a container with an associated product is provided. In the method, a fill spout of the container is coupled with a fill tube of an associated filling apparatus and oxygen is drawn from an inner cavity of the container. The associated product is flowed into the inner cavity through the fill spout of the container together with a nitrogen gas added or otherwise mixed with the product being filled into the inner cavity through the fill spout of the container. After the bag is adequately filled with the product by the nitrogen fill flow, a negative pressure is drawn within the inner cavity relative to areas outside of the container, and the fill spout of the container is sealed. In the example embodiment, the sealing includes sealing the fill spout of the container while the inner chamber is under a negative pressure relative to the areas outside of the container. The drawing of the negative pressure and the sealing while under the negative pressure advantageously results in an immobilization of the associated product within the inner cavity by inward pressure of a wall of the container on the associated product. In an embodiment the coupling of the fill spout of the container with the fill tube of the associated filling apparatus includes inflating a flexible bladder disposed on the fill spout of the container.

In accordance with yet a further example embodiment, a method of packing a container with an associated product is provided, wherein a fill spout of the container is coupled with a fill tube of an associated filling apparatus and oxygen is drawn from an inner cavity of the container. The associated product is fluidizing by entraining the associated product in a moving column of a selected gas. The fluidized product is flowed into the inner cavity through the fill spout of the container together with a nitrogen gas added or otherwise mixed with the product being filled into the inner cavity through the fill spout of the container. A negative pressure is drawn within the inner cavity relative to areas outside of the container, and the fill spout of the container is sealed. In the example embodiment, the sealing includes sealing the fill spout of the container while the inner chamber is under a negative pressure relative to the areas outside of the container. The drawing of the negative pressure and the sealing while under the negative pressure advantageously results in an immobilization of the associated product within the inner cavity by inward pressure of a wall of the container on the associated product. In an embodiment the coupling of the fill spout of the container with the fill tube of the associated filling apparatus includes inflating a flexible bladder disposed on the fill spout of the container.

In accordance with a further example embodiment herein, a bulk bag apparatus as shown and described herein provides a significant barrier to $O_2$ and $H_2O$ transfer; provides for static discharge; and substantially controls the movement of the torrefied materials within the bulk bag apparatus thereby eliminating of substantially abating or friction in and between the torrefied materials within the bulk bag apparatus.

Example embodiments of the subject bulk bag apparatus for safe storage and transport of torrefied materials provide a unique innovative vacuum packaging with $N_2$ purge to prevent fire of torrefied biomass. This is an emerging industry with new and unique safety concerns, which require novel solutions such as are provided by the embodiments of the subject bulk bag apparatus.

Heretofore, commercial bulk sacks failed to use and realize the benefits of vacuum sealing. Also heretofore, commercial bulk sacks failed to use and realize the benefits of an $N_2$ purge during the bag filling operation. Yet still further heretofore, commercial bulk sacks failed to use and realize the benefits of vacuum sealing with an $N_2$ purge. Embodiments of the container and of the container filling method herein use one or more of the vacuum sealing, the $N_2$ purge during the bag filling operation, and/or the combination of the vacuum sealing with the $N_2$ purge.

Example embodiments of the subject bulk bag apparatus further provide for safe storage and transport of torrefied materials wherein one or more oxygen sensors are disposed with in the in-liner bag such as being adhered or otherwise attached with the in-liner bag adjacent to an aperture provided in the outer FIBC bag for observation of the oxygen sensor for visual confirmation of the desired low oxygen content within the in-liner bag.

Example embodiments of the subject bulk bag apparatus further provide for safe storage and transport of torrefied materials wherein the one or more vertically disposed apertures defined by the outer FIBC bag each include a fastener system for selectively closing the elongate vertical aperture and tightening the bag panels and/or gussets on opposite sides of the aperture, wherein in its preferred form, the fastener system includes an elongate cinch strap and a corresponding steel ring buckle member configured to receive the free end of the cinch strap through the steel rings for tightening the bag panels and/or gussets together to thereby close the aperture for shipment of the system.

Additional advantages and features of the embodiments herein will become apparent from the following description and appended claims, taken in conjunction with the accompanying drawings.

BRIEF DESCRIPTION OF THE DRAWINGS

The foregoing and other features of the embodiments herein will become apparent to those skilled in the art to which the present bulk bag apparatus for storage and transport of torrefied materials and method of filling same relate, upon reading the following description with reference to the accompanying drawings, in which.

DETAILED DESCRIPTION OF THE EXAMPLE EMBODIMENTS

Figure 1:
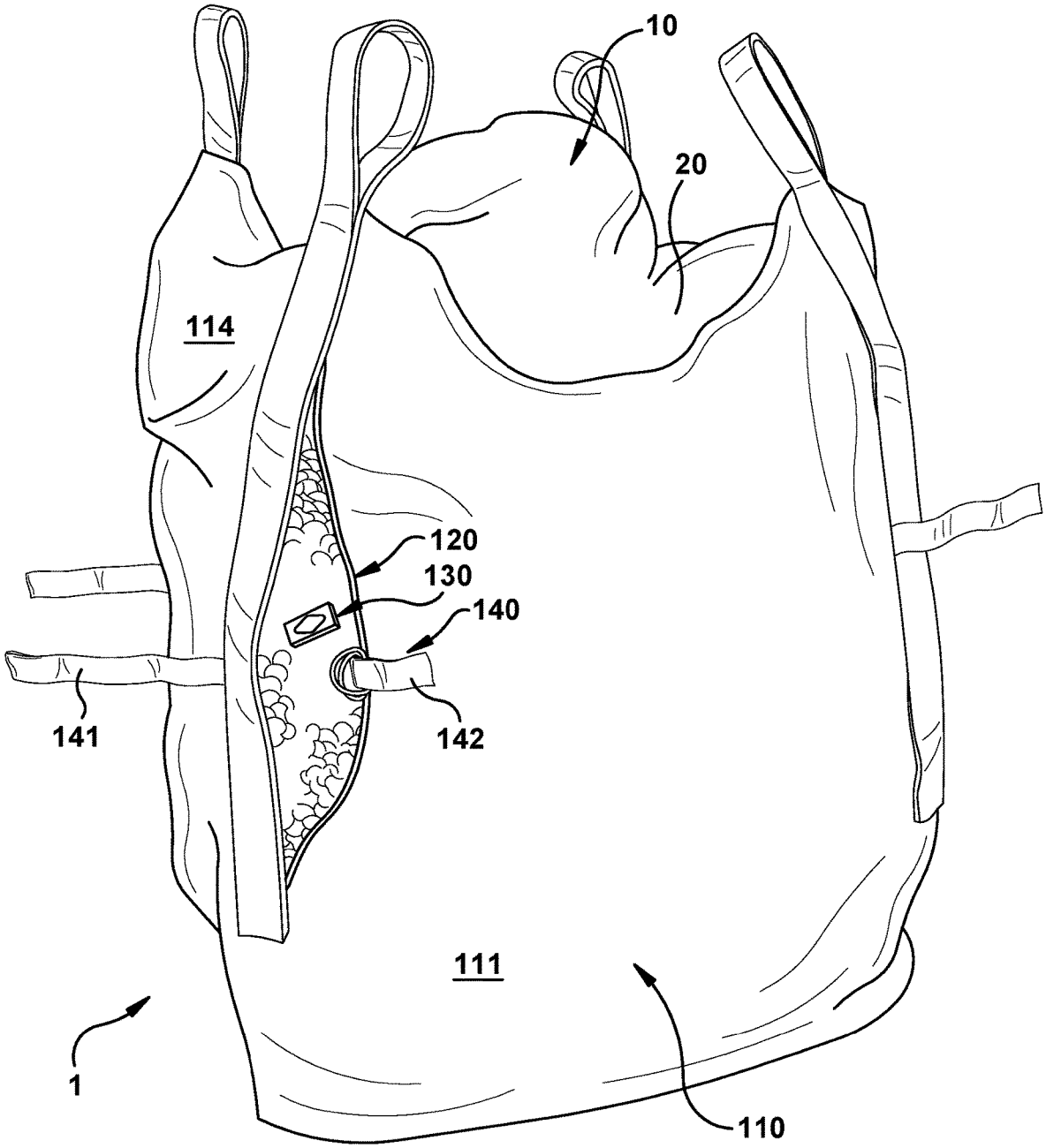
FIG. 1 is a perspective schematic view of a composite bulk storage and transport apparatus in accordance with an example embodiment.

With reference now to the drawing Figures, wherein the showings are for purposes of describing the embodiments only and not for purposes of limiting same, example embodiments herein relate to a container 10 for receiving and holding associated filled product, a composite bulk storage and transport apparatus 100 including a flexible intermediate bulk container (FIBC) device 110 and the container 10 operable as an in-liner container for receiving and holding associated filled product, and to a method 150 of packing a container with an associated product, the container including a melt seal 90 at a discharge spout. It is to be appreciated that the embodiments herein are applicable to many different container schemes and to many different container shapes and/or configurations having various sizes, and other characteristics as may be necessary or desired.

As representative of the embodiments and with reference in particular first to FIG. 1, a composite bulk storage and transport apparatus 100 in accordance with an example embodiment is shown in a perspective schematic view. The composite bulk storage and transport apparatus 100 includes a FIBC device 110 and an in-liner container 10 in accordance with the embodiments to be described in detail below. An elongate vertical aperture 120 is defined by the FIBC device 110 to provide for observation or other viewing of an oxygen sensor device 130 through the aperture 120 and through the clear or otherwise transparent material forming the in-liner container 10 as will be described below in greater detail. In addition, a fastener system 140 is provided spanning the aperture 120 for permitting the aperture 120 to be selectively opened to enable viewing of the oxygen sensor device 130 and closed for permitting the bag to stay sight during transportation thereof.

In its preferred form the composite bulk storage and transport apparatus 100 is generally cube-shaped and, accordingly the FIBC device 110 and the in-liner container configured to be disposed within the FIBC device 110 are cube-shaped as well. To that end, the FIBC device 110 includes a front panel 111, a right gusset 112, a rear panel 113, and a left gusset 114. For purposes of ensuring a tight fit between the FIBC device 110 and the in-liner container 10 disposed within the FIBS device, elongate vertical apertures that can be selectively tightened as may be necessary or desired using means to be described below are provided at each corner of the composite bulk storage and transport apparatus 100. That is, a first elongate vertical aperture is provided between the front panel 111 and the right gusset 112, a second elongate vertical aperture is provided between the right gusset 112 and the rear panel 113, a third elongate vertical aperture is provided between the rear panel 113 and the left gusset 114, and a fourth elongate vertical aperture 120 is provided between the left gusset 114 and the front panel 111. Only the fourth elongate vertical aperture 120 is shown in the figure for ease of illustration.

Figure 1A:
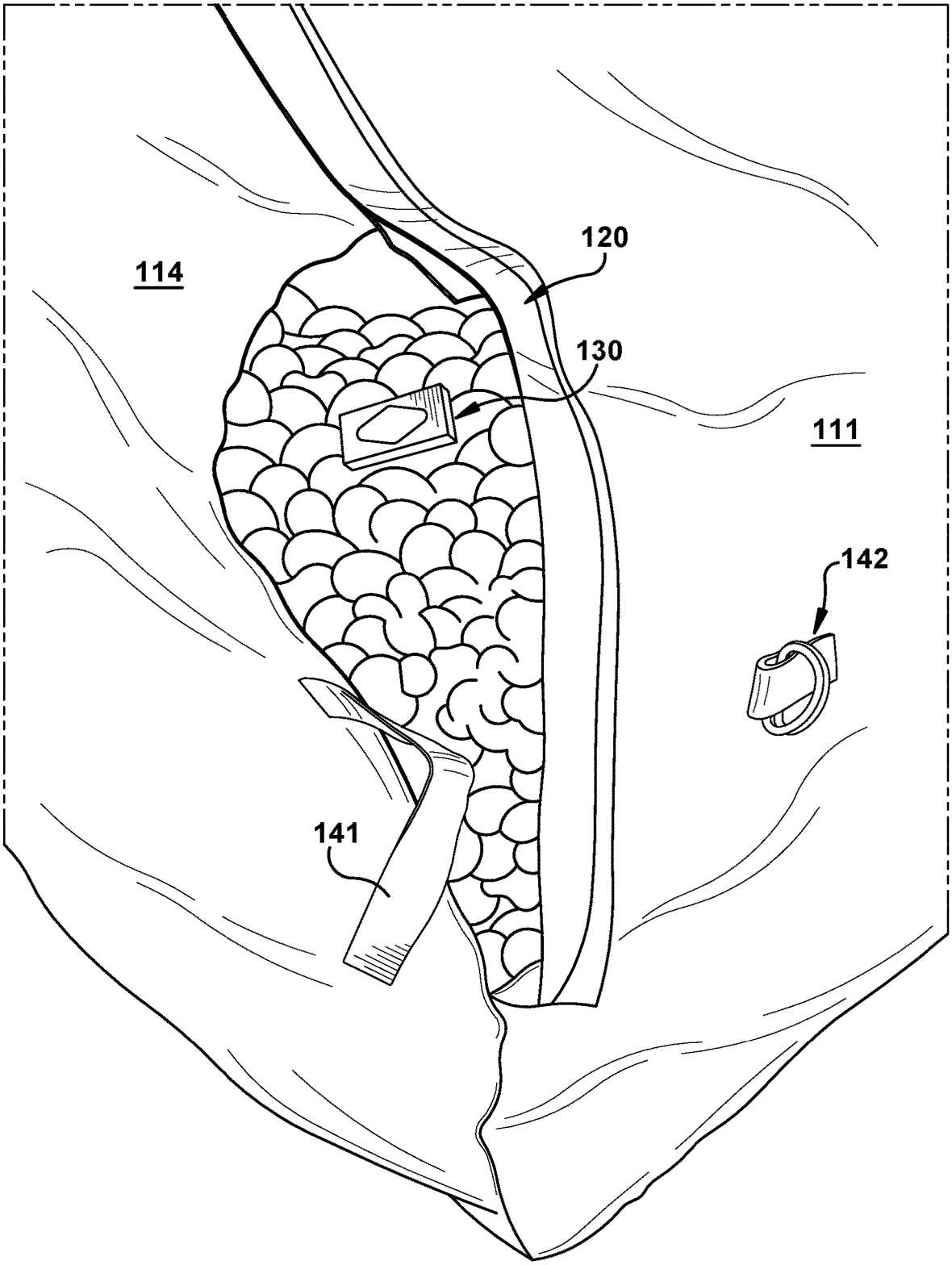
FIG. 1*a* is a perspective schematic view of a composite bulk storage and transport apparatus showing a portion of FIG. 1 enlarged to illustrate an oxygen sensor device disposed adjacent to an opened elongate vertical aperture formed in the outer flexible intermediate bulk container (FIBC) in accordance with an example embodiment.
Figure 1B:
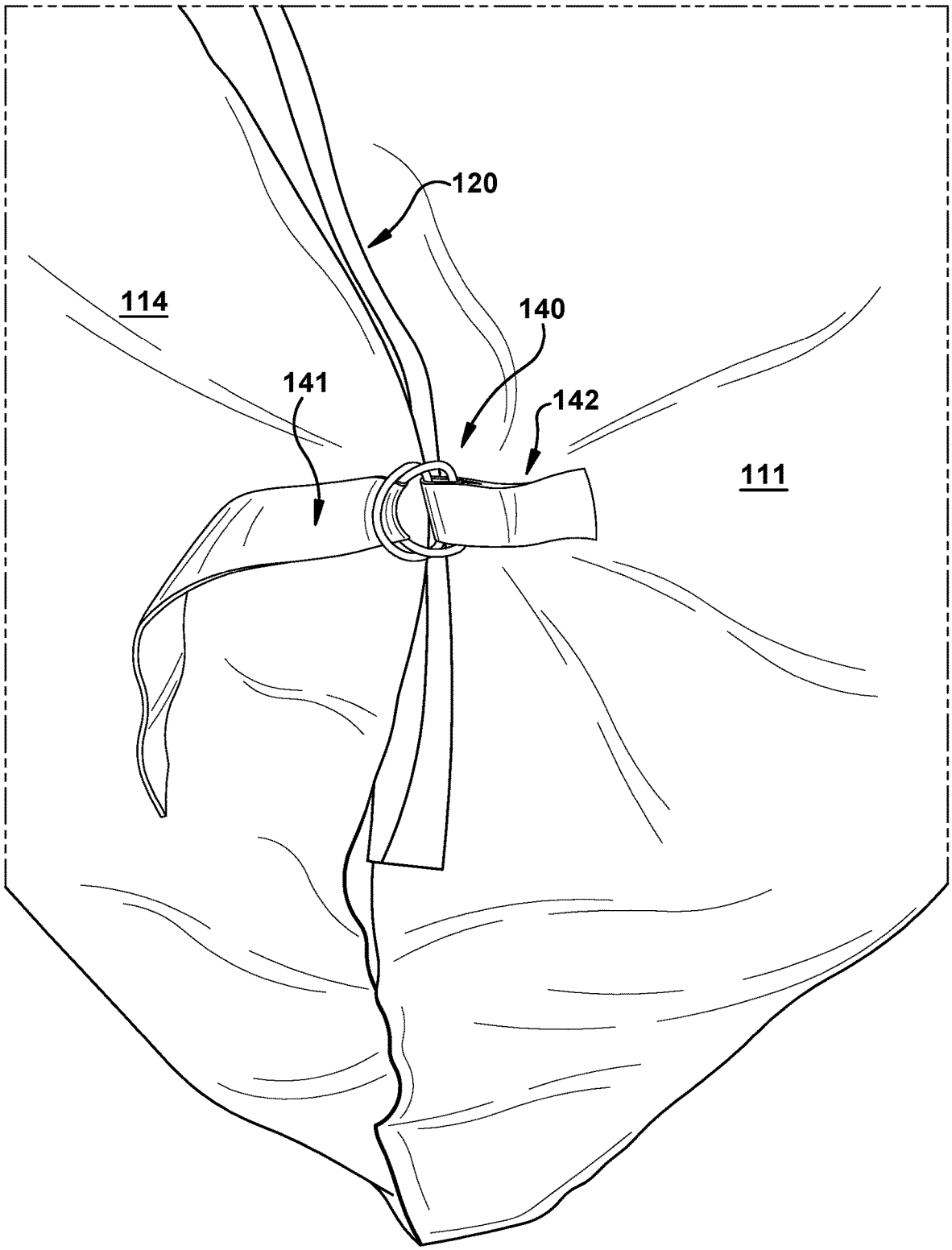
FIG. 1*b* is a perspective schematic view of a composite bulk storage and transport apparatus showing the portion of FIG. 1 as in FIG. 1*a* enlarged to illustrate a fastener system disposed on the outer FIBC to selectively close the elongate vertical aperture formed in the outer FIBC in accordance with an example embodiment.

FIG. 1*b* is a perspective schematic view of the composite bulk storage and transport apparatus of the example embodiment showing a portion of FIG. 1 enlarged to illustrate a fastener system 140 disposed on the outer FIBC to selectively close the aperture 120 formed in the outer FIBC in accordance with an example embodiment. In accordance with the example embodiment, a composite bulk storage and transport apparatus includes a flexible intermediate bulk container (FIBC) device defining an aperture 120, an in-liner container 10 received in an inner space of the FIBC device, and a sensor device 130 disposed in an inner space of the in-liner container located adjacent to the aperture 120 defined in the FIBC device for viewing of the sensor device through the aperture. The FIBC device comprises one or more side members and a bottom member, wherein the one or more side members and the bottom member of the FIBC device define an inner space of the FIBC device. In addition and in accordance with the example embodiment, the one or more side members define at least one aperture 120 for allowing access to the inner space of the FIBC device through the one or more side members defining the at least one aperture. The in-liner container of the example embodiment comprises one or more side members and a bottom member, the one or more side members and the bottom member of the in-liner container define an inner space of the in-liner container for receiving and holding an associated filled product. The in-liner container is received in the inner space of the FIBC device and comprises a multilayered composite film combination forming a bag defining a product fill opening. The multilayered composite film combination comprises a first polymer film having vacuum holding properties wherein the first polymer film acts as an inner layer of the in-liner container, a second polymer film having vacuum holding properties wherein the second polymer film acts as an outer layer of the in-liner container, and a third polymer film disposed between the first and second polymer films wherein the third polymer film has oxygen barrier properties. In the example embodiment, the sensor device senses a level of a chemical in the inner space of the in-liner container and generating a signal representative of the sensed level of the chemical. In one form, the sensor device comprises an oxygen sensor device sensing a concentration of oxygen in the inner space of the in-liner container and generating a signal representative of the sensed concentration of oxygen. In a further form, the oxygen sensor device generates a color signal representative of the sensed concentration of oxygen. One such device that has been shown to work well in combination with the other features of the embodiments described herein is the Oxyeye™ oxygen sensor available from OxyFree® of 4343 Shallowford Road Suite D3 Marietta, Ga. 30062.

In a further form of an example embodiment, the one or more side members of the FIBC device comprise front and back panels 111, 113 and left and right gussets 114, 112 that together with the bottom member define the inner space of the FIBC device. A first elongate vertical aperture (not shown) is defined between the back panel and the left gusset, a second elongate vertical aperture 120 is defined between the left gusset 114 and the front panel 111, a third elongate vertical aperture (not shown) is defined between the front panel 111 and the right gusset 112, and a fourth elongate vertical aperture (not shown) is defined between the right gusset 112 and the back panel 113. A first oxygen sensor device (not shown) is disposed in the inner space of the in-liner and located adjacent to the first elongate vertical aperture, wherein the first oxygen sensor senses a concentration of oxygen in the inner space of the in-liner container near to the first sensor and generates a first color signal representative of the sensed concentration of oxygen in the inner space of the in-liner container near to the first sensor. A second oxygen sensor device 130 is disposed in the inner space of the in-liner and located adjacent to the second elongate vertical aperture 120, wherein the second oxygen sensor senses a concentration of oxygen in the inner space of the in-liner container near to the second sensor and generates a second color signal representative of the sensed concentration of oxygen in the inner space of the in-liner container near to the second sensor. A third oxygen sensor device (not shown) is disposed in the inner space of the in-liner and located adjacent to the third elongate vertical aperture, wherein the third oxygen sensor senses a concentration of oxygen in the inner space of the in-liner container near to the third sensor and generates a third color signal representative of the sensed concentration of oxygen in the inner space of the in-liner container near to the third sensor. A fourth oxygen sensor device (not shown) is disposed in the inner space of the in-liner and located adjacent to the fourth elongate vertical aperture, wherein the fourth oxygen sensor senses a concentration of oxygen in the inner space of the in-liner container near to the fourth sensor and generates a fourth color signal representative of the sensed concentration of oxygen in the inner space of the in-liner container near to the fourth sensor.

In a further form of an example embodiment, the one or more side members of the FIBC device comprise front and back panels and left and right gussets that together with the bottom member define the inner space of the FIBC device. A first elongate vertical aperture is defined between the back panel and the left gusset, a second elongate vertical aperture is defined between the left gusset and the front panel, a third elongate vertical aperture is defined between the front panel and the right gusset, and a fourth elongate vertical aperture is defined between the right gusset and the back panel. In the example embodiment, the FIBC device comprises a first fastener system (not shown) for selectively closing the first elongate vertical aperture and tightening the back panel with the left gusset, a second fastener system 140 for selectively closing the second elongate vertical aperture defined between the left gusset and the front panel, a third fastener system (not shown) for selectively closing the third elongate vertical aperture and tightening the front panel with the right gusset, and a fourth fastener system (not shown) for selectively closing the fourth elongate vertical aperture and tightening the right gusset with the back panel. In its preferred form, the second fastener system includes an elongate cinch strap 141 and a corresponding steel ring buckle member 142 configured to receive the free end of the cinch strap 141 through the steel rings for tightening the left gusset together with the front panel to thereby close the second aperture 120 for shipment of the system. Likewise, the cinch strap 141 can be loosened from the steel rings of the buckle ember 142 for selectively permitting the opening of the aperture for permitting viewing of the sensor device 130 through the aperture 120. Although only one (1) aperture, sensor device, and fastener system 140 is shown in the drawing Figures for purposes of helping to prevent clutter in the drawings, it is to be appreciated that each of the four (4) corners or edges of the FIBC device may similarly be provided with equivalent apertures, fastener systems, and sensor devise as may be necessary or desired.

Figure 1C:
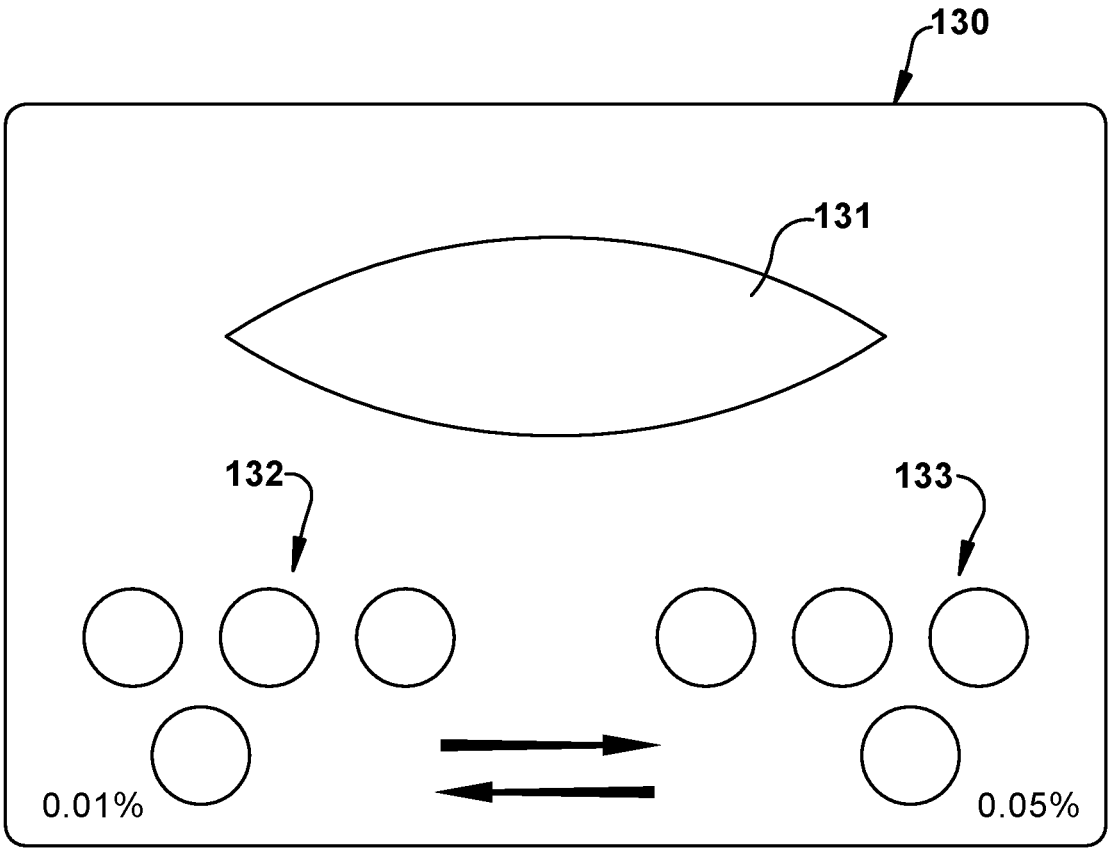
FIG. 1*c* is a plan view of the oxygen sensor device of FIGS. 1 and 1*a* disposed in the composite bulk storage and transport apparatus of the example embodiments.

FIG. 1*c* is a plan view of the oxygen sensor device to be disposed in the composite bulk storage and transport apparatus of FIGS. 1, 1*a*, and 1*c*. As shown there, the sensor senses oxygen in the bag and, in particular, a level or concentration of oxygen in the bag. Preferably, the oxygen sensor device 130 includes a display region 131 that shows or otherwise renders a pink color when the oxygen content is below 1% (good for storing and transporting torrefied products as fire cannot occur in less than 5% oxygen), and shows or otherwise renders a blue color when the oxygen content is over 5% (bad for storing and transporting torrefied products as fire can occur in as little as about 5% oxygen). Pink represents about 1% oxygen, and purple/blue represents about >5% oxygen. A first set of colorized comparison gage balls 132 transition in color from pink to slightly blue towards a second set of colorized comparison gage balls 133. Correspondingly, the second set of colorized comparison gage balls 133 transition in color from blue to pink blue towards the first set of colorized comparison gage balls 131. This makes it easier for the human eye to quickly and effectively determine an approximate oxygen content within the bag. In the embodiments herein, one or more oxygen sensor devices or indicators are affixed to the inside of the bag liner inside of the front left corner side slits. The corner slits and straps are designed to allow the bag shell to be cinched in to make the shell more form fitting to the liner, accentuating the flat cubic shape. Colorized instructions are printed on a portion of the sensor device or on a card placed adjacent to the sensor device. As shown, an arrow adjacent to the slit points to the eye location.

The slit or aperture in the example embodiment then becomes dual purpose: allowing the shell to form fit the liner, and also providing an inspection port for the Oxygen sensor device.

To reduce and substantially eliminate the risk of fire and/or explosion, the embodiments of the bulk bag herein have been uniquely engineered to provide a Modified Atmosphere Package (MAP). In the embodiments herein, the atmospheric conditions inside of the package are deliberately modified by special package and process design to produce a specific environment beneficial to reducing the chance of fire in the contents of the package.

In this regard, the embodiments of the subject bulk bag apparatus in accordance with the present application provide many benefits. These include, without limitation, at least the benefits of the prevention of sparks during use of the bulk bag apparatus, an inert atmosphere inside the package air tight barrier to keep oxygen out through a removal of oxygen from the bag during the product filling process in combination with a nitrogen flush, and the prevention of ignition by friction (FIGS. 7 and 8) renders the atmosphere inside the package inert owing to a technique of vacuum sealing immobilization through vacuum compression, which holds the product within the bag in a tight pack.

Figure 9:
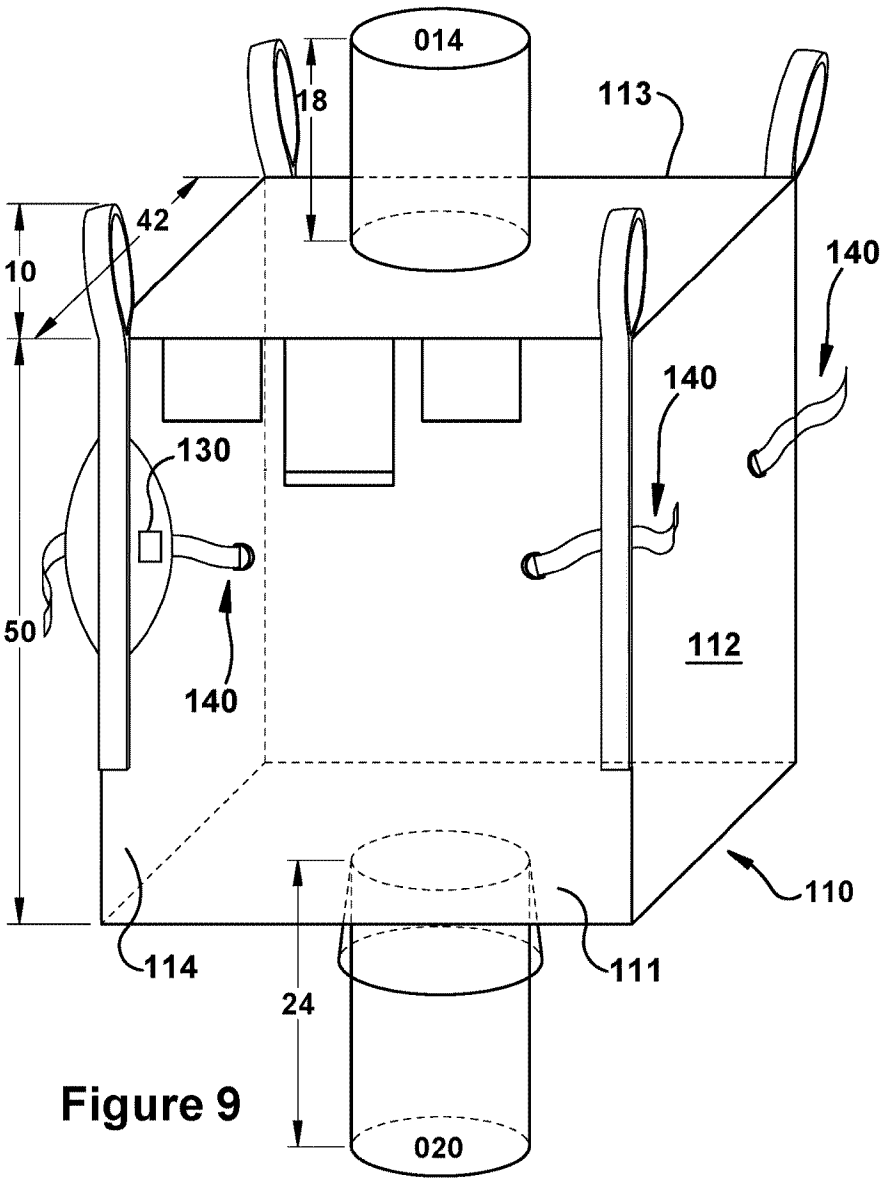
FIG. 9 is an assembly drawing showing the flexible intermediate bulk container portion of the composite bulk storage and transport apparatus in accordance with an embodiment.

In an embodiment, the subject composite bulk storage and transport apparatus 100 apparatus includes a FIBC device 110 and a container 10. In its preferred form, the FIBC device is a Type "B" dissipative shell shown in FIGS. 2 and 9, and the container 10 is preferably an integral proprietary film liner shown in FIGS. 3 and 11 that prevents sparking and potential ignition of its contents. The integral film liner 10 is shown inserted and sewn into the shell of the FIBC device 110 in FIG. 4. Any type of outer shell device may be used, but Type "B" dissipative shells manufactured by Conitex/SONOCO of Charlotte, N.C. made from woven polypropylene fibers with a static dissipative additive to help prevent static sparking are particularly useful and advantageous.

Figure 3:
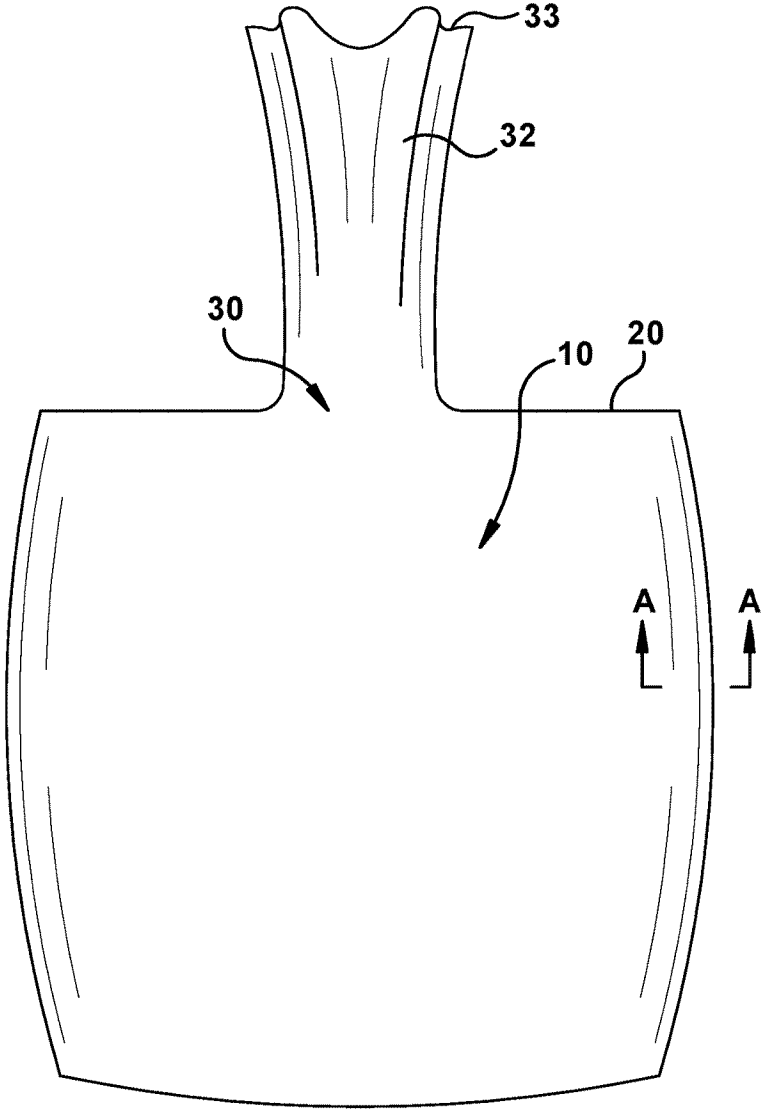
FIG. 3 is a diagrammatical view showing an in-liner container portion removed from the outer composite bulk storage and transport apparatus shown in FIG. 2.
Figure 8:
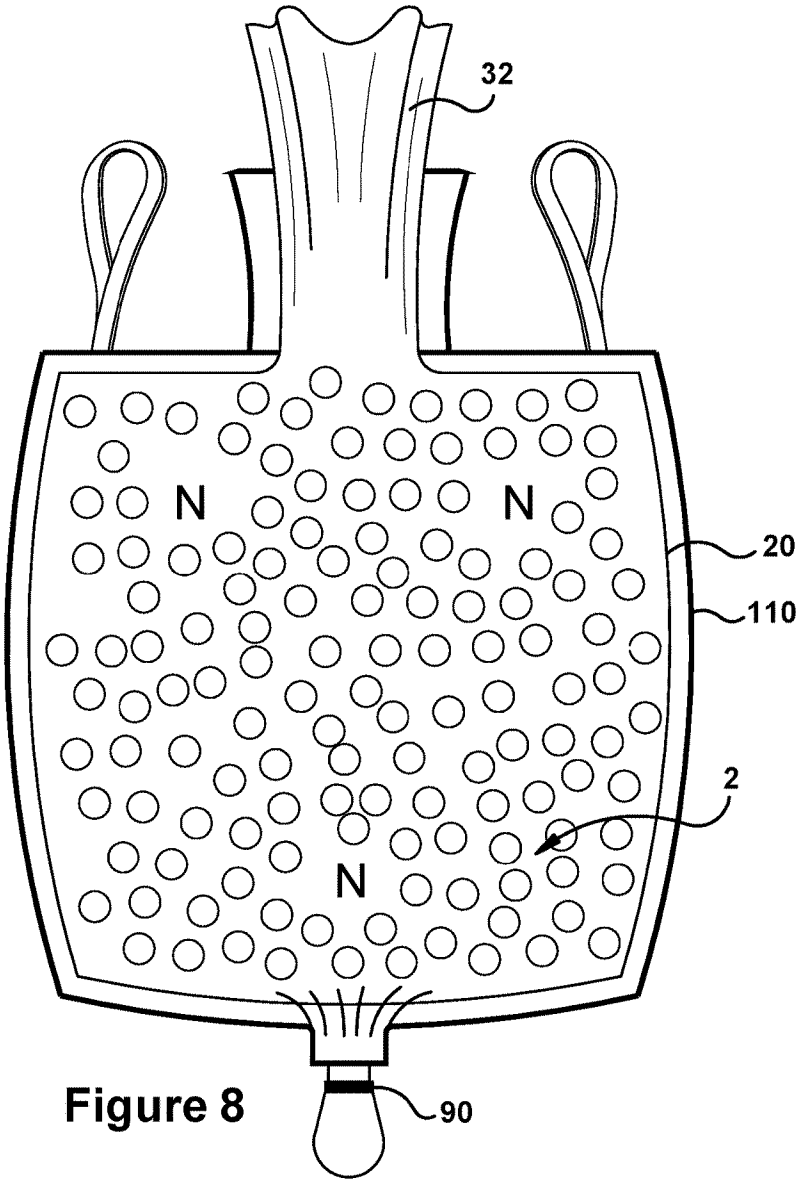
FIG. 8 is a diagrammatical view showing nitrogen and the product immobilized within the in-liner container portion of the composite bulk storage and transport apparatus following the filling method of an embodiment.
Figure 10:
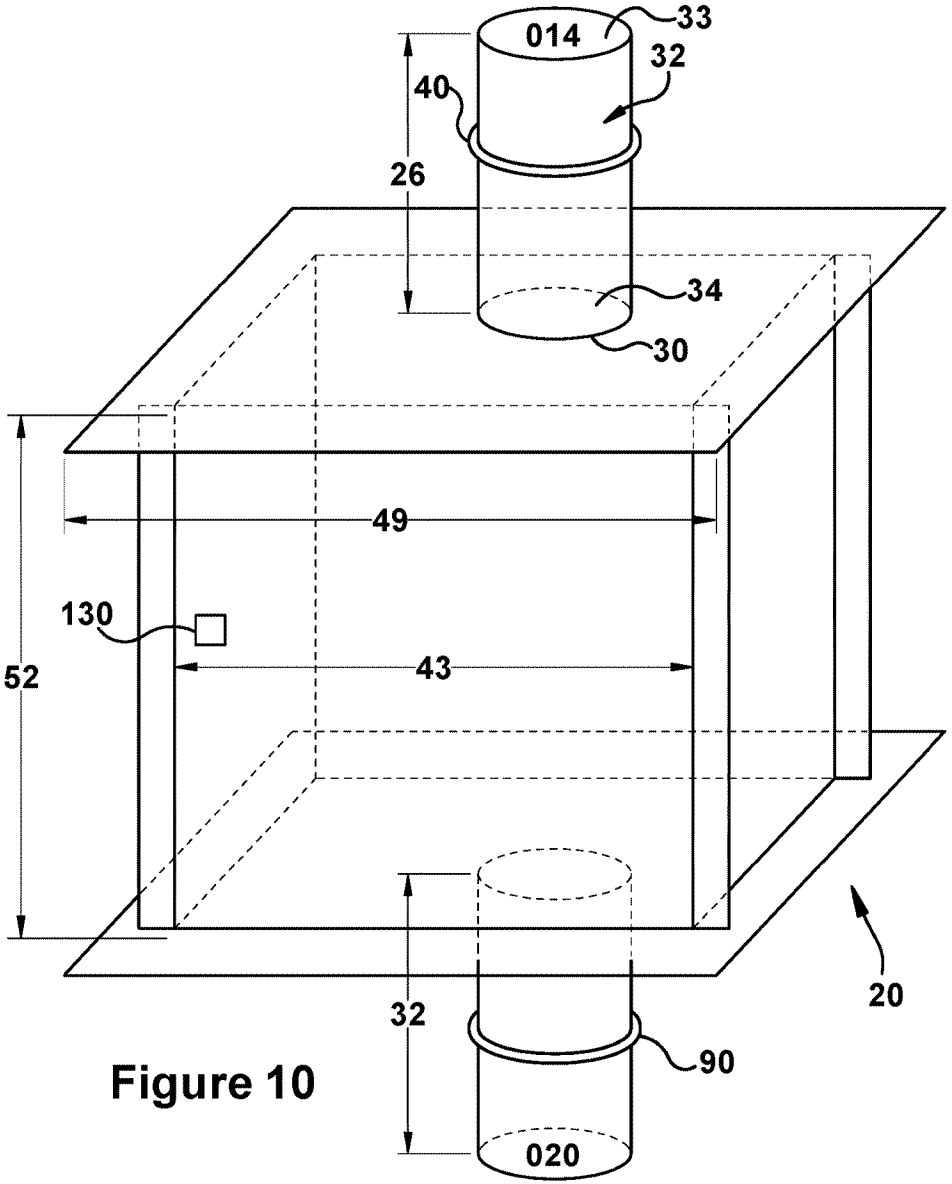
FIG. 10 is an assembly drawing showing the in-liner container portion of the composite bulk storage and transport apparatus in accordance with an embodiment.

The proprietary film liner 10 shown in FIGS. 3 and 10 also creates an air tight barrier to keep oxygen out as shown in FIG. 8. No oxygen results in less chance of fire or explosion. In accordance with the of example embodiment, the container comprises a multilayered composite film combination forming a bag defining a product fill opening. The multilayered composite film combination comprises a first polymer film having vacuum holding properties, a second polymer film having vacuum holding properties, and a third polymer film disposed between the first and second polymer films. The first polymer film acts as an inner layer of the container, and the second polymer film acts as an outer layer of the container. Preferably, the third polymer film is impervious to a flow of selected gasses such as for example oxygen and/or nitrogen.

Figure 3B:
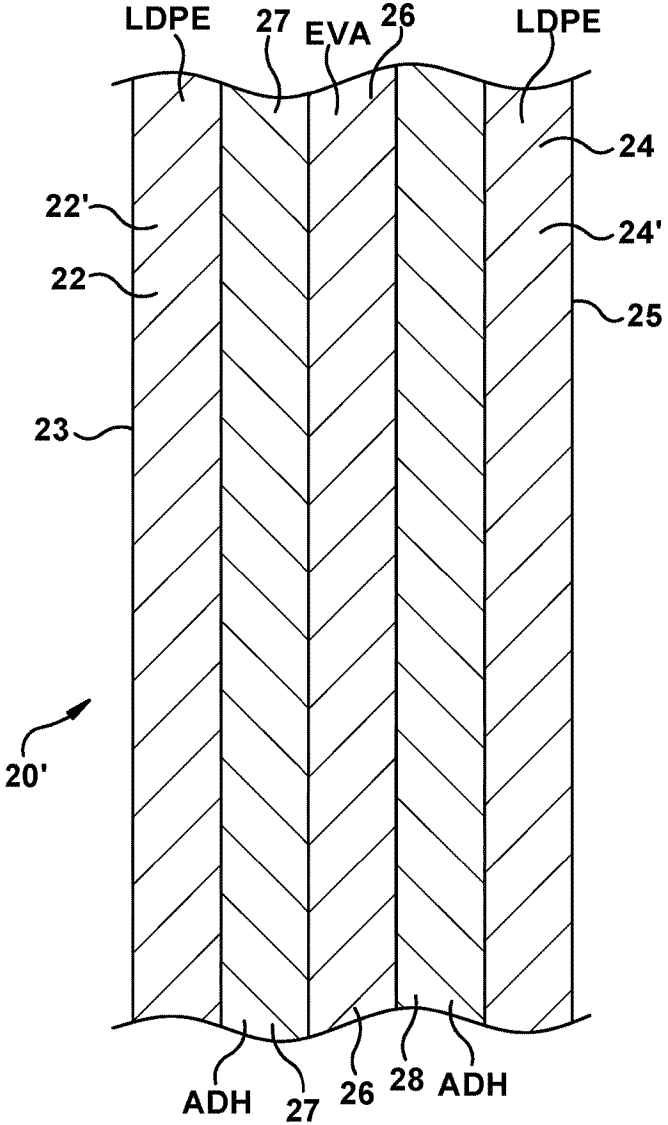
FIG. 3B is a cross-sectional view of the in-liner portion of the composite bulk storage and transport apparatus in accordance with a second embodiment taken through line A-A of FIG. 3.
Figure 3A:
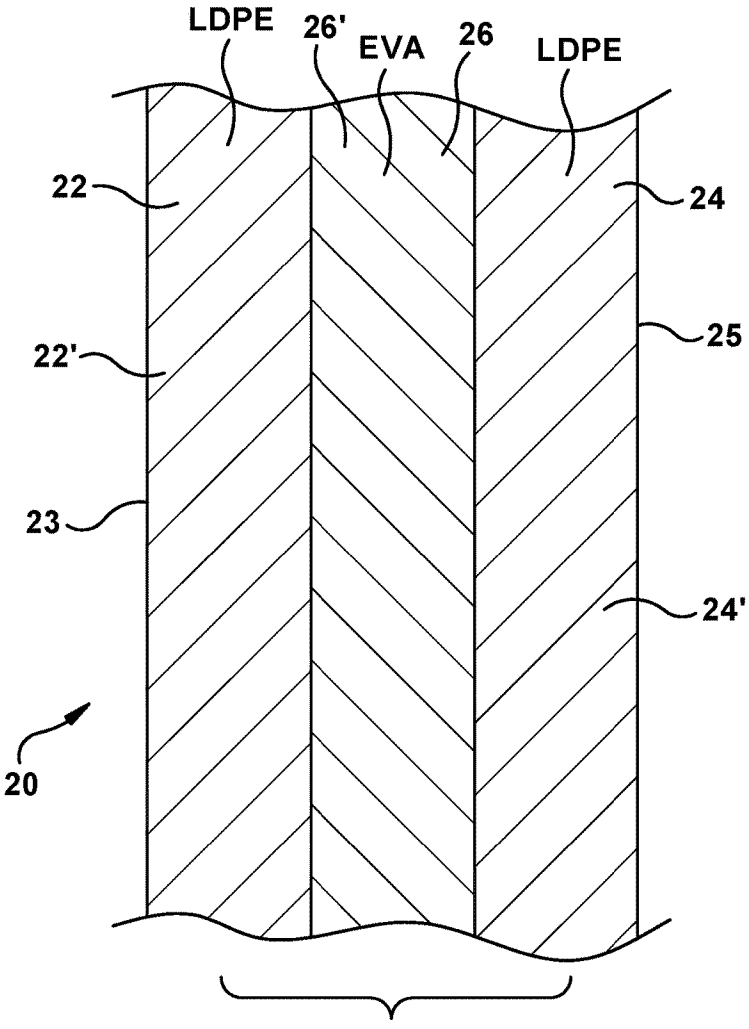
FIG. 3A is a cross-sectional view of the in-liner portion of the composite bulk storage and transport apparatus in accordance with a first embodiment taken through line A-A of FIG. 3.

As best shown in the cross-sectional view of FIG. 3A, the film liner in accordance with a first embodiment is 3 mil ldpe/eva/ldpe with a static dissipative additive added, to help prevent static sparking, and with two layers of ldpe instead of a single layer to provide a thicker, stronger, airtight vacuum seal. The provision of two separate layers of low melt temperature ldpe is unique to this bulk package design. Normal industry practice uses a single layer of ldpe or other low melt temperature sealing film; however, the need for absolutely air tight seals in the subject bulk sack necessitates the provision of twice the sealing material as standard industry practice. Also, standard industry seals on a bulk package liner are ¼ wide. The subject bulk package utilizes ⅜" seals, to provide more strength and better vapor barrier properties to the package. The specification and use herein of the food grade EVA (ethylene vinyl acetate) barrier film layer resulted from extensive testing and produces a layer with outstanding barrier values to both $O_2$ and $H_2O$ transfer. This specific film liner structure, comprised of a double sealing layer of ldpe, a static dissipative additive, and the unusual provision of a superior EVA film vapor barrier, combined with the Type B static dissipative shell, is unique to bulk package construction at the current time.

Specifically in the example embodiment, the first and second polymer films comprise low density polyethylene (LDPE) films, and the third polymer film comprises an ethylene-vinyl acetate (EVA) film. The first and second LDPE films provide an airtight vacuum seal, and the EVA film is impervious to a flow of oxygen therethrough. The EVA film is impervious to a flow of nitrogen therethrough.

The ldpe/eva/ldpe film liner is preferably a tri-lamination formed by a method of direct co-extrusion, a process in which hot melted layers of different polymer films are extruded together to form a single unit film structure with superior adhesion properties between the layers, to prevent de-lamination. As shown in FIG. 3A the layers are in intimate contact with each other. The multilayered composite film combination is a co-extrusion of the LDPE and EVA films arranged as illustrated. The LDPE and EVA films are in intimate contact with each other, and are preferably fused together as a single unitary film structure using for example the co-extrusion process.

The specification of the food grade EVA barrier film layer resulted from extensive testing and produces a layer with outstanding barrier values to both $O_2$ and $H_2O$ transfer. The overall film structure of the subject bag is preferably airtight, but at the same time, the subject bulk sack design is preferably able to withstand the forces inherent to a 1,500 lb. bulk sack. This is a unique requirement for a MAP package at the present time. Most flexible MAP packages are designed for the food industry and are, therefore, tiny, wherein much smaller packages, from 1 oz. to 1 lb. are common. The strength of the typical MAP film structure can therefore be much less. This specific film liner structure, combined with the Type B static dissipative shell, is unique to bulk package construction of the embodiments herein.

An alternate embodiment multilayered composite film combination is shown in FIG. 3B. The composite film structure is formed by adhesively laminating the three layers of polymer films (LDPE and EVA) into a composite structure, with a layer of adhesive (ADH) between each layer to hold the laminate together. The multilayered composite film combination comprises a first polymer film having vacuum holding properties, a second polymer film having vacuum holding properties, and a third polymer film disposed between the first and second polymer films. The first polymer film acts as an inner layer of the container, and the second polymer film acts as an outer layer of the container. Preferably, the third polymer film is impervious to a flow of selected gasses such as for example oxygen and/or nitrogen. As best shown in the cross-sectional view of FIG. 3B, the film liner is 3 mil ldpe/adh/eva/adh/ldpe with a static dissipative additive added, to help prevent static sparking, and with two layers of ldpe instead of a single layer to provide a thicker, stronger, airtight vacuum seal. The provision of two separate layers of low melt temperature ldpe is unique to this bulk package design. Normal industry practice uses a single layer of ldpe or other low melt temperature sealing film; however, the need for absolutely air tight seals in the subject bulk sack necessitates the provision of twice the sealing material as standard industry practice. Also, standard industry seals on a bulk package liner are ¼ wide. The subject bulk package utilizes ⅜" seals, to provide more strength and better vapor barrier properties to the package. The specification and use herein of the food grade EVA (ethylene vinyl acetate) barrier film layer resulted from extensive testing and produces a layer with outstanding barrier values to both $O_2$ and $H_2O$ transfer. This specific film liner structure, comprised of a double sealing layer of ldpe, a static dissipative additive, and the unusual provision of a superior EVA film vapor barrier, combined with the Type B static dissipative shell, is unique to bulk package construction at the current time.

Specifically in the example embodiment, the first and second polymer films comprise low density polyethylene (LDPE) films, and the third polymer film comprises an ethylene-vinyl acetate (EVA) film. The first and second LDPE films provide an airtight vacuum seal, and the EVA film is impervious to a flow of oxygen therethrough. The EVA film is impervious to a flow of nitrogen therethrough. The ADH layers bind the LDPE layers with the EVA layer.

The specification of the food grade EVA barrier film layer resulted from extensive testing and produces a layer with outstanding barrier values to both $O_2$ and $H_2O$ transfer. The overall film structure of the subject bag is preferably airtight, but at the same time, the subject bulk sack design is preferably able to withstand the forces inherent to a 1,500 lb. bulk sack. This is a unique requirement for a MAP package at the present time. Most flexible MAP packages are designed for the food industry and are, therefore, tiny, wherein much smaller packages, from 1 oz. to 1 lb. are common. The strength of the typical MAP film structure can therefore be much less. This specific film liner structure, combined with the Type B static dissipative shell, is unique to bulk package construction of the embodiments herein.

A still further alternative embodiment is to substitute the EVA film layer with nylon film, to provide $H_2O$ and $O_2$ barrier properties. In any case, the preferred embodiment at the time of this application is to co-extrude the alternating LDPE/EVA/LDPE film structures, and the alternate embodiment is to adhesive laminate the film structure using an adhesive resulting in an overall LDPE/ADH/EVA/ADH/LDPE film structure.

Figure 5:
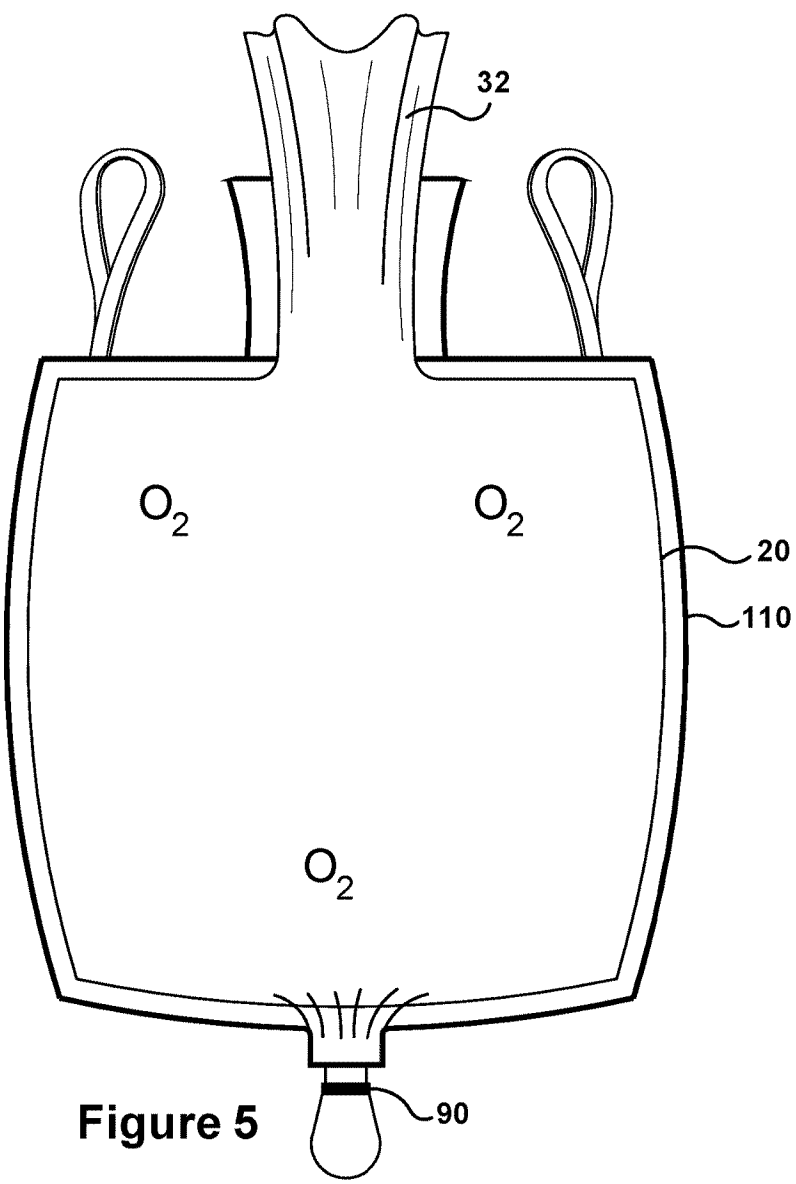
FIG. 5 is a diagrammatical view showing the in-liner container portion of the composite bulk storage and transport apparatus filled with atmosphere including oxygen prior to a filling method of an embodiment.
Figure 7:
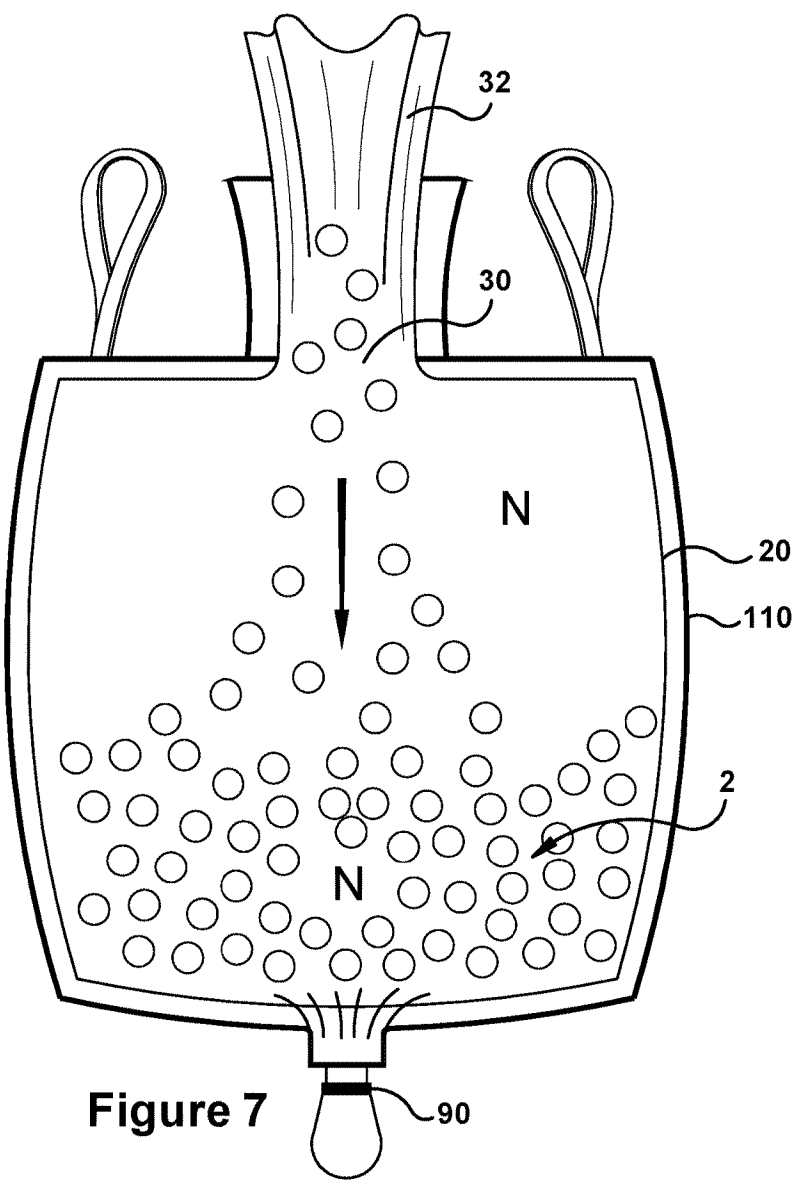
FIG. 7 is a diagrammatical view showing product and nitrogen being simultaneously added into the in-liner container portion of the composite bulk storage and transport apparatus during the filling method of an embodiment.
Figure 6:
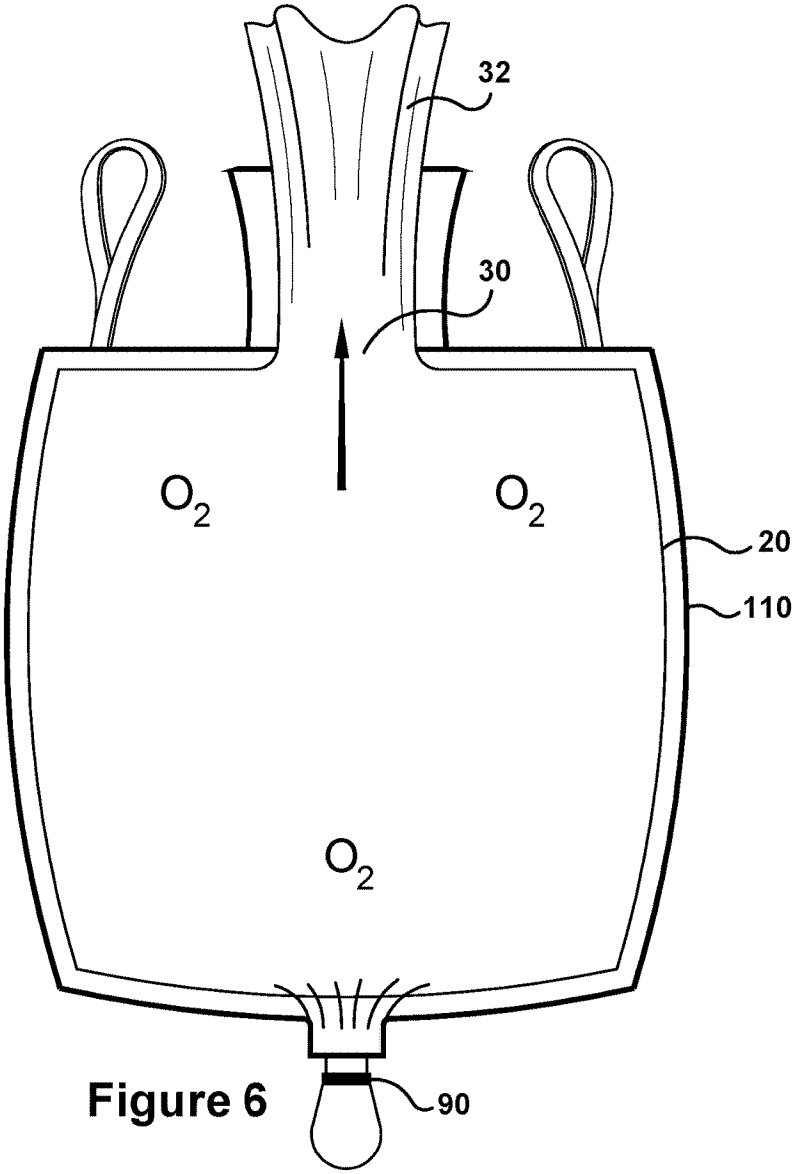
FIG. 6 is a diagrammatical view showing the atmosphere including the oxygen being removed from the in-liner container portion of the composite bulk storage and transport apparatus during the filling method of an embodiment.

While keeping oxygen out is important, removing oxygen as illustrated in FIGS. 5 and 6 from the bag during the filling process is also very important. Through a dual approach of nitrogen flush as illustrated in FIGS. 7 and 8 and by vacuum sealing, which removes and also displaces oxygen inside the bag, the oxygen content is reduced, preferably to just 1%. Importantly, the innovative $N_2$ purge renders the atmosphere inside the package inert.

Also, the torrefied particles are immobilized through vacuum compression, which prevents ignition by friction. It has been suggested that shaking and vibrating of the material particles inside regular Type A woven polypropylene supersacks and not immobilized through the novel and unique vacuum compression method, system and structures in accordance with the embodiments, herein could produce static sparking, or heat from friction caused by the particles rubbing against each other, or against the walls of the bulk bag. Both sparking and friction hot spots in prior systems are possible sources of ignition to the highly flammable torrefied biomass. In accordance with the embodiments herein, however, compressing the particles immobilizes them, which prevents the particles from rubbing against each other, or against the wall of the bulk sack, thereby preventing the generation of a static discharge or heat from friction.

To best help facilitate providing the inert atmosphere within the subject bag as well as to help provide for the immobilization of the product within the bag, the container 10 of the example embodiment further includes a fill spout operatively coupled with the bag at an opening thereof, and a flexible bladder member carried on the fill spout adjacent to the second opening. The fill spout has a generally cylindrical conformation defining a first opening in fluid tight connection with the product fill opening of the bag, and a second opening configured to receive the associated filled product into the bag through the fill spout and the product fill opening. In addition, the flexible bladder member is configured to be selectively inflatable for selectively coupling the fill spout with an associated fill tube communicating the associated product. The bladder member is operative to couple the fill spout with the associated fill tube when the bladder is in an inflated condition and to decouple and release the fill spout from the associated fill tube when the bladder member is in a deflated condition The unique structure of the subject bulk bag apparatus simultaneously: substantially eliminates static sparking, removes oxygen from inside the sack and replaces it with inert nitrogen, disposes an oxygen sensor within the bag together with the torrefied product for low oxygen atmosphere verification, and compresses the contents to prevent ignition by friction. No other known bulk sack offers this degree of protection.

Figure 11:
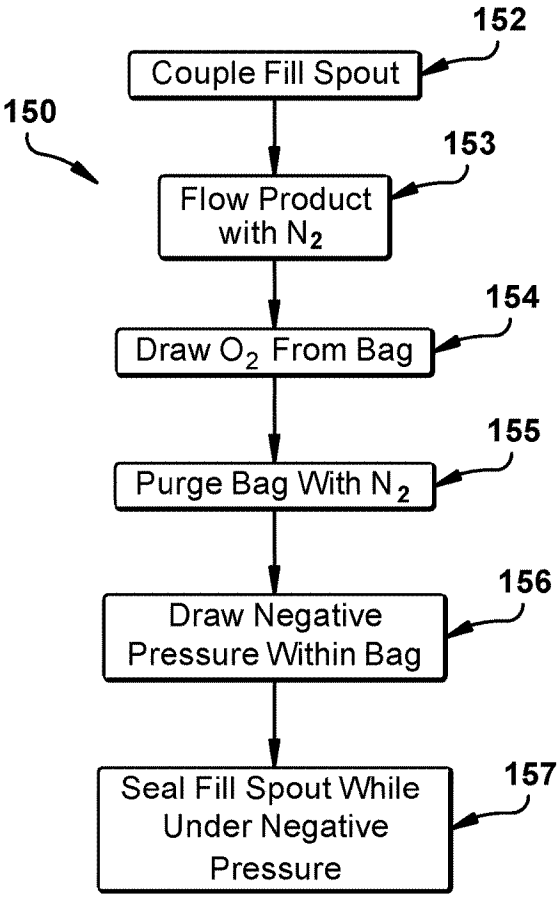
FIG. 11 is a flow chart showing a method of packing a container with an associated product in accordance with an embodiment.

In accordance with an embodiment, in a bag filling process as best shown in FIG. 11, the subject bulk bag apparatus is placed into an associated form that can have, for example, a box shape, and can, for example, be made of metal, plastic, wood or any other material. This allows the bags to fill to a uniform shape to minimize damage during handling, permit stacking, and to provide a visual cue that the contents are under vacuum. It is to be appreciated that the subject bulk bag apparatus in accordance with the example embodiment comprises a fill spout which is fitted with a rubber bladder. The fill spout is selectively inflatable with compressed air to draw the neck tight around a fill tube of the associated filling system, to eliminate combustible dust or contaminants from being released during filling. After a vacuum is drawn on the bag contents, the sack is removed from the form, but retains the shape and dimensions of the form, because of the vacuum. Also, preferably during the filling process, the subject bulk bag apparatus is placed on or in an associated compaction table of an associated filling system, wherein the associated compaction table vibrates to settle and help compress the incoming material and also move the oxygen out (FIGS. 7 and 8).

More particularly, the method 150 method of packing a container with an associated product, the method comprises an initial step 152 of coupling a fill spout of the container with a fill tube of an associated filling apparatus. It is to be appreciated that the bag is provided with a 3/16" to 1/4" melt seal 90 at a discharge spout thereof, and that the melt seal 90 is indeed sealed before coupling the fill spout of the container with a fill tube of an associated filling apparatus. In one form the melt seal 90 is a 3/16" to 1/4" melt seal 90 provided at the discharge spout of the bag. In another form, the melt seal 90 is provided by a pair of 2.7 mm. parallel seals provided at a discharge spout of the bag. It has been found that a pair of 2.7 mm. parallel melt seals at the discharge spout of the bag provides a stronger and better bond than prior products and/or techniques. In any case, the associated product is flowed at step 153 together with nitrogen gas into the inner cavity through the fill spout of the container. Preferably and in accordance with the example embodiment, the product is fluidized in step 153 by entraining the associated product in a moving column of a selected gas. Thereafter in step 153, the thereby fluidized associated product is caused to flow into the inner cavity through the fill spout of the container. Next, at step 154 oxygen ($O_2$) is drawn from an inner cavity of the container. Nitrogen ($N_2$) is selectively added at step 155 into the inner cavity through the fill spout of the container to purge the bag of any remaining oxygen. A negative pressure is drawn at step 156 within the inner cavity relative to areas outside of the container. Lastly, the fill spout of the container is sealed at step 157 while the bag is under negative pressure.

Preferably, the drawing the negative pressure immobilizes the associated product within the inner cavity by inward pressure of a wall of the container on the associated product. The drawing of the negative pressure beneficially immobilizes the associated product within the inner cavity by inward pressure of a wall of the container on the associated product. This helps to ensure that no movement between the product pieces occurs due to product settling and during handing of the bag such as during transport or the like. Also preferably, the sealing comprises sealing the fill spout of the container while the inner chamber is under a negative pressure relative to the areas outside of the container. In that way, vacuum sealing immobilization through vacuum compression holds the product within the bag in a tight pack thereby minimizing the chance of relative movement between the product pieces and therefore also minimizing the chance for friction buildup between the product pieces during handling and/or transport of the subject bulk bag.

In a preferred embodiment, as the filling progresses, in a vacuum process stage, the sealer measures the air pressure content and once the desired PSI is achieved, preferably about 20" Hg or, equivalently, about 12 PSI, the vacuum portion of the associated filling system automatically turns off. A vacuum of about 10 PSI would work very well also. This vacuuming process takes approximately 1 minute or less. The fill and discharge spouts of the associated filling system are designed to allow re-use and re-filling of the subject bulk bag apparatus in accordance with the example embodiment, resulting in greater cost efficiency.

In addition, while, for purposes of simplicity of explanation, the methodology 150 of FIG. 11 is shown and described as executing serially, it is to be understood and appreciated that the example embodiment is not limited by the illustrated order, as some aspects could occur in different orders and/or concurrently with other aspects from that shown and described herein. Moreover, not all illustrated features may be required to implement a methodology in accordance with an aspect the example embodiment. Example methodologies described herein are suitably adapted to be implemented in any system, devices, hardware, or a combination thereof.

In a further embodiment, the diameter of a bottom spout of the subject bulk bag apparatus is increased from industry standard diameter of 15," to a 20" diameter to help prevent bridging and rat-holing of the material contained within the bag, and to help achieve free flow during discharge.

In one embodiment, the subject bulk bag apparatus in accordance with the example embodiment has a 51 cubic foot capacity. However, it is to be appreciated that the embodiments are not limited to this size or to any other size, and may take on any dimensions as may be necessary or desired. The subject bulk sack dimensions are determined by the bulk density of the given torrefied material (biochar, biocoal, plastic fillers, sorbents, etc.). Therefore, subject bag size will vary to accommodate the most efficient configuration for the subject material bulk density. The objective in custom sizing the subject bulk sacks by the material contents bulk density is to permit more efficient double stacking of the sacks into a transport container. Stacking the subject sacks into two layers, instead of one layer inside a shipping container maximizes the weight per shipment of the products, by as much as 40% per shipment over a single layer of larger bulk sacks. The intentional smaller size and compressed, preformed cube shape of each subject sack permits easier stacking and improved handling characteristics, with less chance of damage to the sack, because the subject sack conforms precisely with the outside dimensions of the associated pallets and does not overhang. The most common damage to bulk sacks occurs when forklift operators puncture the bulk sack at a point where the filled bag overhangs the pallet. The second most common damage to filled bulk sacks occurs when the same bag overhang snags against a protuberance inside the shipping container when loading the sacks by forklift. The preformed cube shape of the subject bag does not overhang the pallet dimensions, so the chance of damage during handling is much reduced. The ability to make the subject bag conform to a pre-formed shape is unique to the industry, and no other bulk sack offers this solution.

Figure 4:
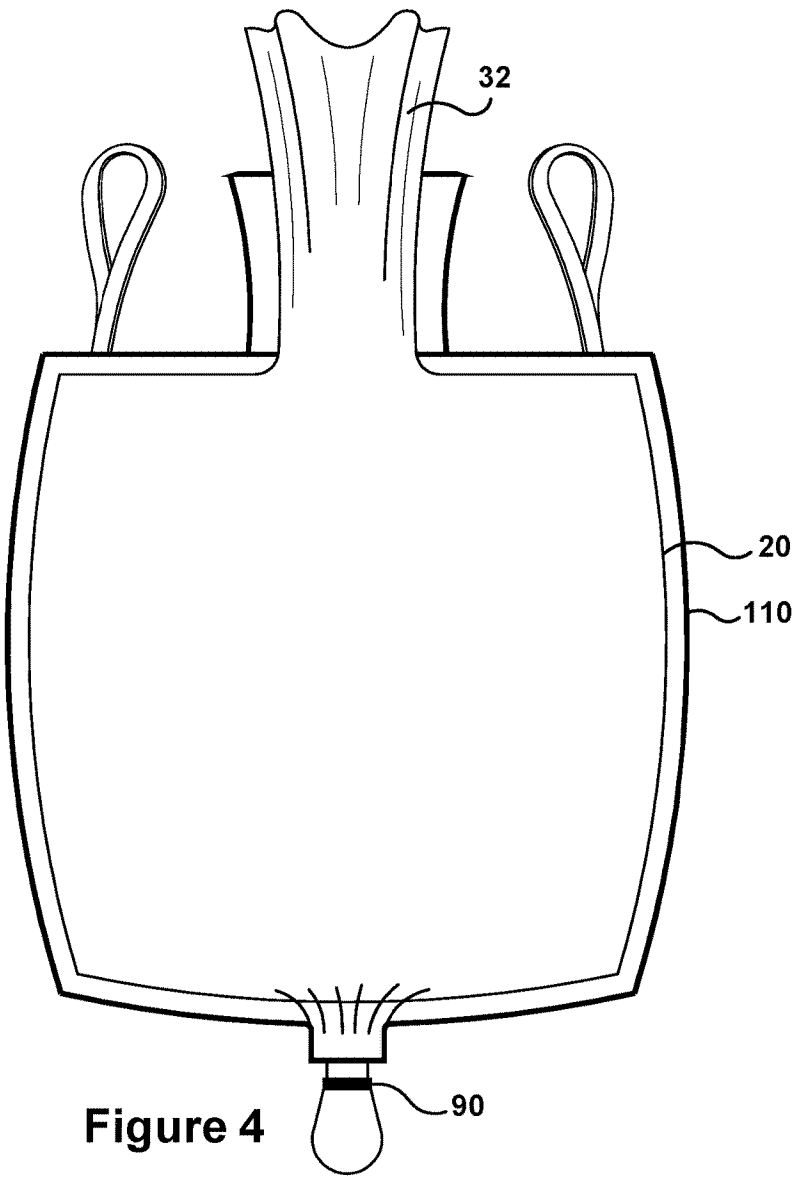
FIG. 4 is a diagrammatical view showing a flexible intermediate bulk container portion of the composite bulk storage and transport apparatus of FIG. 2 shown in partial phantom.

In the embodiments herein, preferably, the liner of FIGS. 3 and 10 is located into and then sewn into the Type B dissipative shell (FIGS. 2 and 9) as shown in FIG. 4. Production bulk bag apparatus include dissipative shells that are form-fitted to the liner to present a clean, cube like appearance. The cube shape makes it less liable to damage during handling and facilitates stacking.

The embodiments herein combine a vacuum sealing process, static dissipative materials, vacuum compression, unusually strong, airtight construction, $N_2$ purge, with large bulk sacks having liners to provide a unique bulk packaging solution for the emerging torrefaction industry. In this regard, primarily though not necessarily exclusively for purposes of scaling the packaging to a 1500 lb highly functional supersack, for example, the subject FIBC package is specifically designed to help reduce the chance of fire or explosion with torrefied materials or biochar, by removing one or more legs of the Fire (Combustion) Triangle or Explosion Pentagon. The subject bulk package helps to remove heat (ignition sources) and oxygen, which comprise two of the legs of the combustion triangle. Fire cannot occur unless all three legs are present. If one or more legs are removed, then fire is impossible. Potential sources of heat like friction or static sparking are also limited in the design of the embodiments herein. Likewise with the explosion pentagon; by removing one or more legs of the pentagon, namely, oxygen and heat, an explosion cannot occur. The subject bulk sack is designed to help eliminate two required conditions for a fire or explosion to occur—oxygen and heat.

Figure 2:
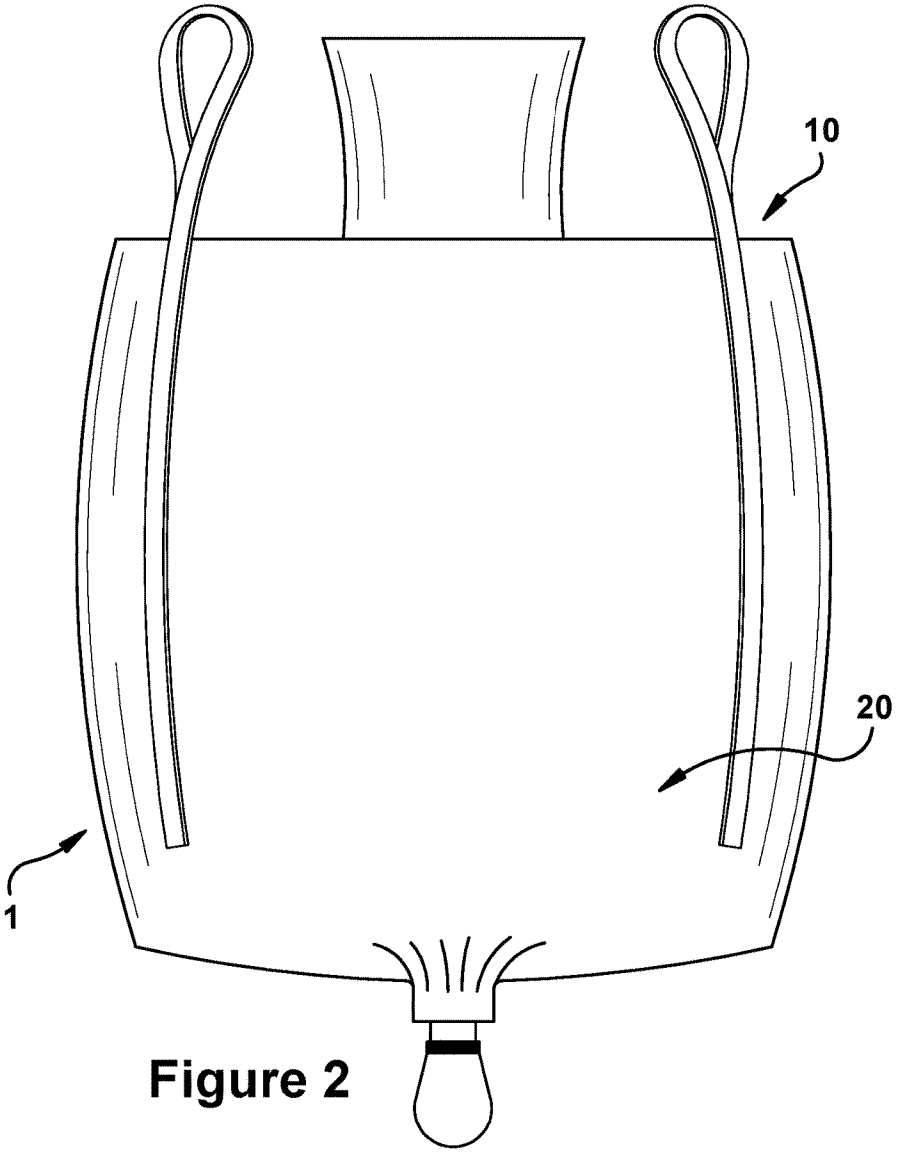
FIG. 2 is a diagrammatical view of the composite bulk storage and transport apparatus shown in FIGS. 1, 1*a*, and 1*b;*

It is to be appreciated that the embodiments of the liner shown in FIG. 2 and of the dissipative shell shown in FIG. 3 are for purposes of illustrating the novel concepts of the subject bulk bag apparatus and for explanation thereof. It is to be further appreciated that the embodiments of the liner shown in FIG. 9 and of the dissipative shell shown in FIG. 10 are preferred commercial embodiments having the proportions and properties as specified in FIGS. 10 and 12, respectively.

Some features of the bulk bag apparatus described herein include, but are not necessarily limited to: Type B static Dissipative Shell helps reduce static charge build up and prevent sparking; proprietary ldpe/adh/eva/adh/ldpe film structure with static dissipative additive also helps to eliminate static sparking events; and the airtight, watertight, high barrier properties of the proprietary film liner structure prevents oxygen from transferring through the package walls, keeping oxygen away from the contents during transport and storage.

Vacuum sealing removes oxygen from inside the subject bulk sack to prevent contents from igniting. The $N_2$ purge displaces residual oxygen inside the subject bulk sack to prevent contents from igniting, and surrounds the contents with inert gas. Vacuum compresses and immobilizes the particles for shipment, and prevents friction hot spots as a source of ignition. The cubed form of the bag apparatus reduces chance of damage from handling (the cube does not overhang the pallet). The discharge spout diameter has been increased from the industry standard 15" to 20" diameter, depending on the flow characteristics of the torrefied material to be packaged. The increased spout diameter increases the angle of repose of the packed material, reduces bridging and rat holing during discharge, and facilitates free flow of the material out of the subject bulk package.

All seals in the subject package have been increased from industry standard ¼ width to ⅜" width to provide sufficient strength and reduce the chance of seam leakage.

Example embodiments of the subject bulk bag apparatus for safe storage and transport of torrefied materials provide a unique innovative vacuum packaging with $N_2$ purge to prevent fire of torrefied biomass. This is an emerging industry with new and unique safety concerns, which require novel solutions such as are provided by the embodiments of the In accordance with further embodiments, a system is provided enabling filling and handling bulk bag apparatus containing torrefied and other materials. In general, the system fills the bulk bag apparatus having an oxygen sensor disposed therein with the torrefied and/or other materials together with or simultaneously with a secondary gas such as nitrogen, carbon-dioxide, or the like, for example. The system then evacuates air (and therefore oxygen) from the bulk bag apparatus containing the torrefied and other materials. The system further seals a plastic portion of the bulk bag apparatus containing the torrefied and other materials.

It is to be appreciated that the systems and methods of the example embodiments described herein are not just for use with torrefied materials but, to the contrary, can also be used to package other bulk dry materials such as powdered dry chemicals, and dried whole or ground spices, vegetables, or herbs. Use of the systems and methods of the example embodiments are described relative to Torrefied materials for ease of explanation and as an example of a material that would be greatly benefited by the systems and methods of the example embodiments.

As a general overview, a system is disclosed herein for evacuating air from a plastic bag that has already been filled with any material for storage purposes such as, for example, torrefied materials. After evacuating the air from a plastic bag filled with the material, the system is operable to inject the evacuated bag with a secondary gas, such as nitrogen, carbon-dioxide, or the like, for example to replace the evacuated air with the secondary gas. Thereafter, the system is operable to seal the bag in order the keep or otherwise maintain the secondary gas and material contained inside the bag in a sealed condition within the plastic bag.

In general and as an overview of the system function, the example embodiment of the system described herein performs several separate functions for effectuating its intended use. It is to be appreciated that one or more of the functions to be described below could be combined as may be necessary and/or desired. It is to be further appreciated that one or more of the functions to be described below could be expanded into further functions and/or sub-functions as may be necessary and/or desired.

In the description below, it is assumed that the system receives a plastic bag to be filled with a material such as, for example, torrefied materials. In some cases the material within the bag could be granular in nature, or small particles, such as sawdust, for example.

The functions to be performed by the system in accordance with the example embodiment described herein include without limitation the functions of: filling a bag with a torrefied product entrained in a secondary gas flow, such as a nitrogen or carbon-dioxide gas stream; evacuating the air trapped in the porosity of the material stored in the plastic bag without removing biochar particles from inside the bag; shape-forming the bag system into a cubic form or shape for ease of stacking and handling; selectively as may be necessary or desired injecting a further secondary gas, such as nitrogen, or carbon-dioxide, into the porosity of the material in the bag; and sealing the bag via a heat-sealing device in order to prevent air entering the bag.

As an overall system description, the support system 1200 (FIG. 12) of the example embodiment shown in the drawing Figures appended herewith comprises an integration of units or sub-systems, each performing a one of the specific functions mentioned previously, namely, filling a bag with a torrefied product entrained in a secondary gas flow, such as a nitrogen or carbon-dioxide gas stream; evacuating the air trapped in the porosity of the material stored in the plastic bag without removing biochar particles from inside the bag; shape-forming the bag system into a cubic form or shape for ease of stacking and handling; selectively as may be necessary or desired injecting a further secondary gas, such as nitrogen, or carbon-dioxide, into the porosity of the material in the bag; and sealing the bag via a heat-sealing device in order to prevent air entering the bag.

As shown, the support system of the example embodiment includes several sub-systems including a filling system 1210, a vacuum system 1220, a sealing system 1230, and a shape forming system 1240. The filling system 1210, the vacuum system 1220, and the sealing system 1230 are pivotally carried on a framework 1250 of the support system 1200 on corresponding pivot joints so that they may be individually pivoted into position when needed, and conversely pivoted away when not needed.

Figure 13:
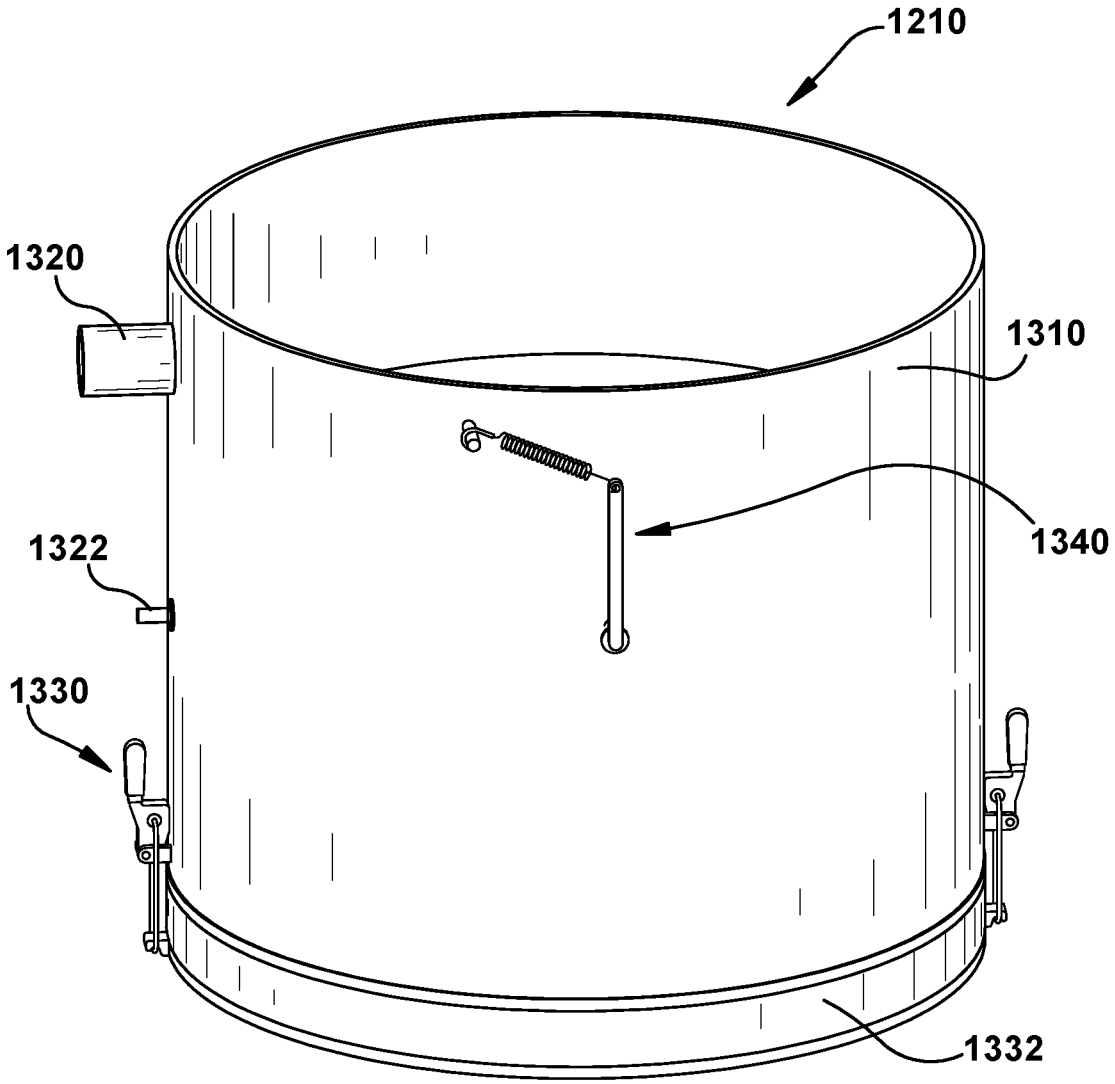
FIG. 13 is a gas and product fill sub-system of an example embodiment.

One system of the example embodiments for supporting filling and handling bulk bag apparatus containing torrefied materials includes a filling system 1210 (FIG. 13) configured to inject a secondary gas, such as nitrogen, or carbon-dioxide, together with the product of material; a vacuum subsystem 1220 (FIG. 14) configured to evacuate the air trapped in the porosity of the material stored in the plastic bag and selectively back gas-fill the interstitial product space with the secondary gas, such as nitrogen, or carbon-dioxide, a sealing subsystem 1230 configured to seal the bag via a heat-sealing device in order to prevent air entering the bag; and a cubic forming system 1240 (FIGS. 15*a*-15*d*) for shape-forming the bag system into a cubic form or shape for ease of stacking and handling. The cubic forming system 1240 holds the associated bulk bag apparatus in a predetermined cubic shape.

The filling sub-system 1210 includes a cylindrical body member 1310 configured to port the product into the bag. The cylindrical body member 1310 is pivotally carried on the framework 1250 by a mounting bracket 1320. For fluidizing the product as it passes through the body member 1210, a hose fitting 1322 adapts the body member 1310 for connection to a source of a secondary gas, such as nitrogen, or carbon-dioxide. A clamp system 1330 is provided for connecting the bag neck with the body member to receive the product without spillage. In addition, a spring-loaded butterfly valve 1340 is included for acting as a switch to control the flow of fluidized product.

Figure 12:
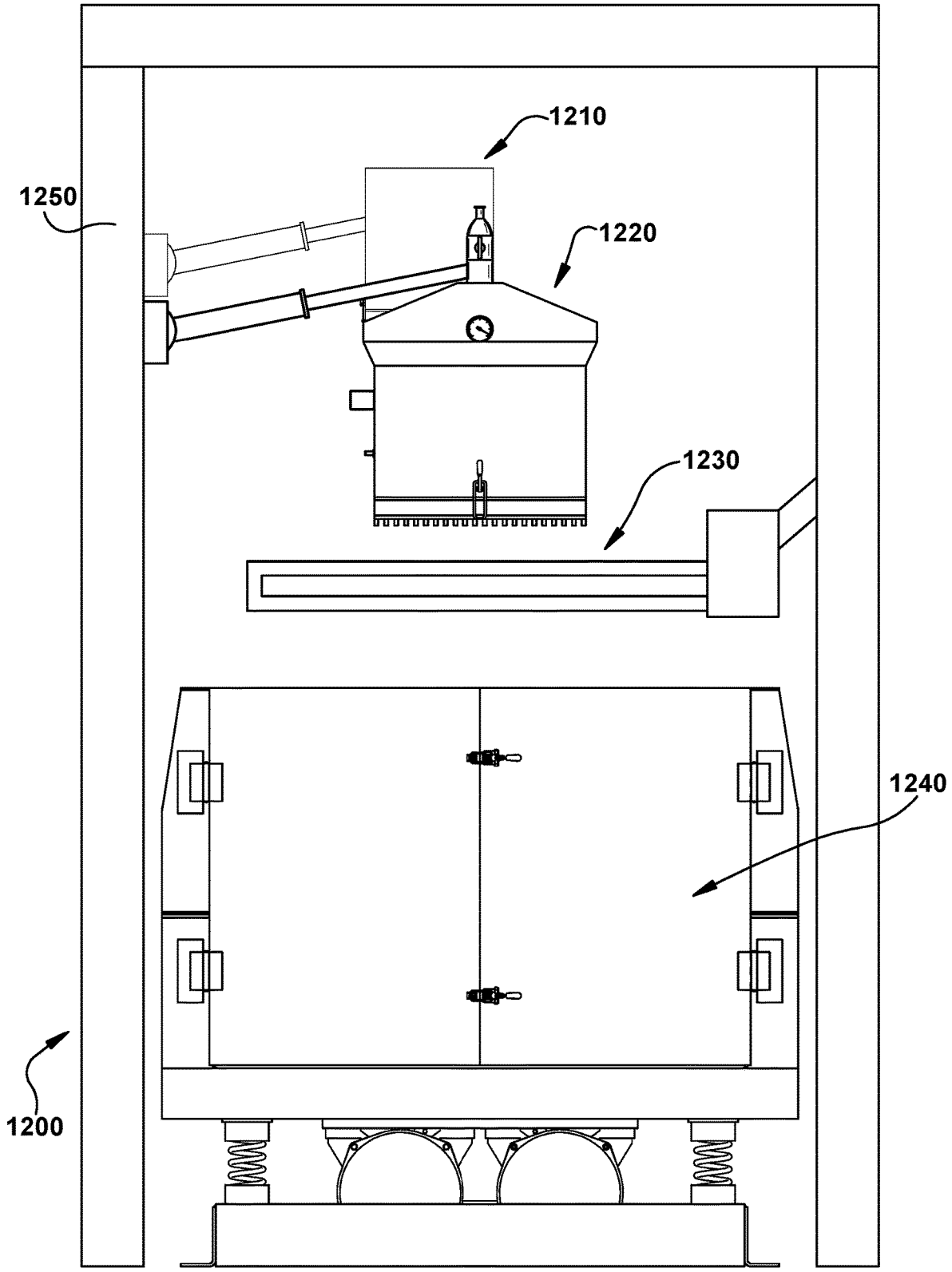
FIG. 12 shows a system supporting handling the composite bulk storage and transport apparatus of the embodiments including filling, evacuating and for-shaping the composite bulk storage and transport apparatus in accordance with an embodiment.

A sealing subsystem 1230 of the example embodiment is shown in FIG. 12 and includes a horizontally mounted electric sealing device is mounted on the distal end of a telescoping column, resembling a boom on the vertical column. The sealing device has a scissor-type jaws; the height of said jaws can be adjusted such that a heat-sealed line can be formed at a desired line on the spout portion of the plastic bag to seal the spout.

Figure 14:
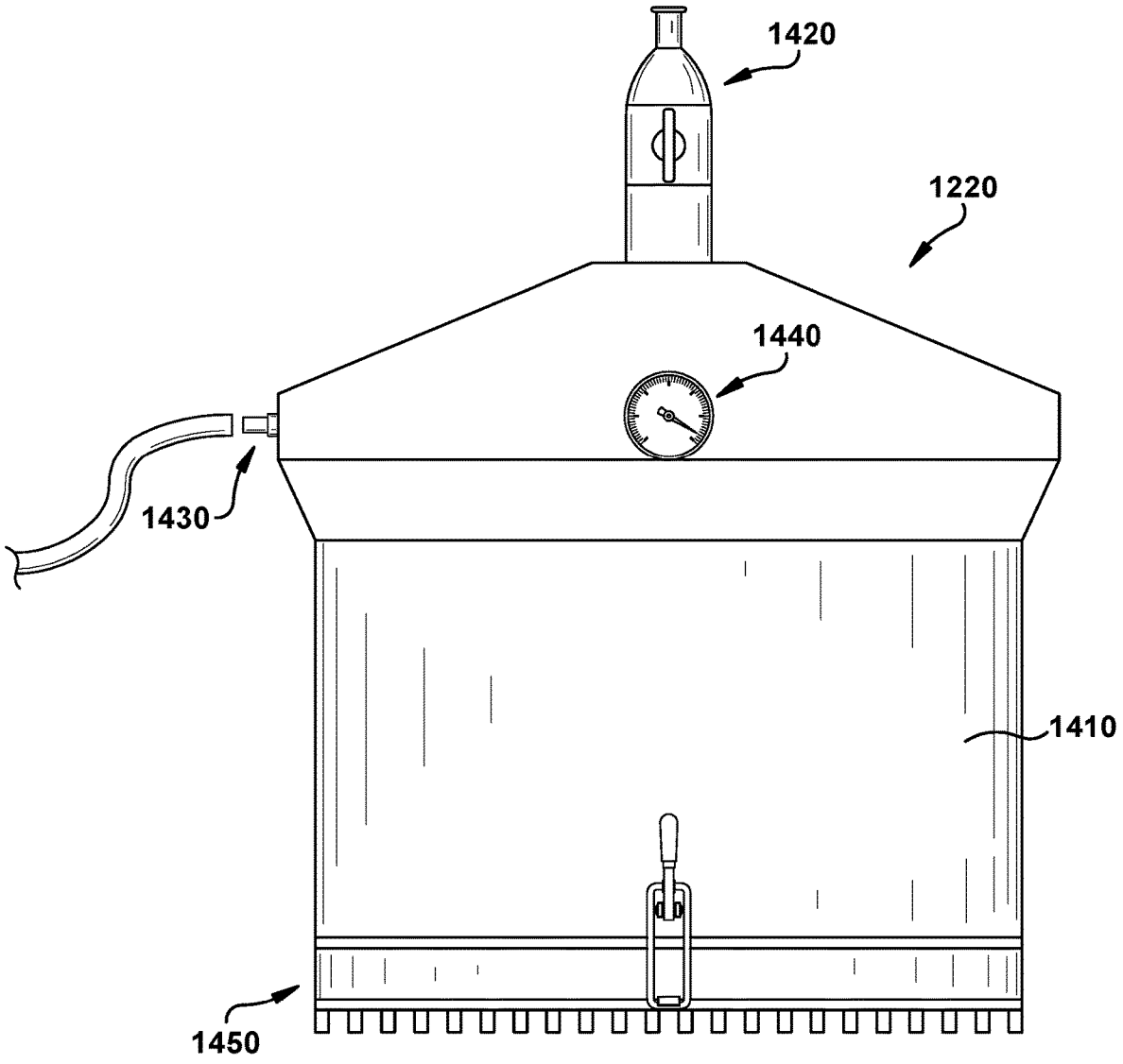
FIG. 14 is a gas-fill and vacuum sub-system of an example embodiment.

With reference to FIG. 14 a vacuum sub-system 1220 is shown for evacuating air from a plastic bag that has already been filled with any material for storage purposes such as, for example, torrefied materials. A vacuum nozzle 1410 is attached to a boom which is in turn attached to the framework 1250. The vacuum nozzle faces downwardly as viewed in the drawing figure, and is adapted or otherwise configured to penetrate into the spout of a plastic bag that is filled with a material.

In use, the distal end of the bag's spout is stretched over the tip of the nozzle, making the subsystem ready for air evacuation from the bag. The other end of the nozzle is attached to a vacuum pump for extracting air from the bag that is filled material.

In its preferred form, the air is evacuated using a special, high volume, low velocity vacuum nozzle connected to a vacuum pump. The special shape of the vacuum nozzle removes the air from the inside of the plastic bag at a velocity lower than the settling velocity of the material being packed. This prevents the material from being sucked out of the plastic by the vacuum.

In its preferred form, the vacuum nozzle of the example embodiment performs multiple functions: 1) the design permits low velocity, high volume and faster evacuation of air from inside the bag via a vacuum connection 1420, 2) this accelerates the vacuum process and prevents small material particles from being inadvertently removed from the bag; 3) the open end of the nozzle contains small tubes to prevent the fill spout walls being drawn into the nozzle by vacuum pressure; and 4) it permits discharge of $N_2$ into the bag via a plumbing fitting 1430, and it 5) has a gauge 1440 to measure negative pressure in the bag prior to heat sealing.

In a further preferred form, a specialized interface 1450 is provided to prevent the walls of the film spout of the plastic bag from collapsing when the filling spout of the plastic bag is placed under vacuum. Without the specialized interface 1450, the walls of the film spout may collapse, substantially reducing the volume of the air being evacuated from the bag.

The specialized interface is, in an example embodiment, a sheet of plastic polypropylene mesh, such as would be used in an onion bag, and is selectively disposed between the film walls of the spout, to facilitate the air flow out of the bag. The junctions in the polypropylene mesh consist of a bead, which is of greater thickness than the mesh strands. This permits the free flow of air evacuated from the bag, when the mesh is placed between the walls of the fill spout of the bag. This mesh prevents the walls of the fill spout of the bag from fully collapsing under negative pressure, thus ensuring free flow of air out of the plastic bag.

FIG. 14 is an illustration showing a vacuum sub-system 1220 in accordance with a physical commercial example embodiment for evacuating air from a plastic bag that has already been filled with any material for storage purposes such as, for example, torrefied materials. In the embodiment illustrated, a low velocity nozzle is provided. The low velocity nozzle is a device specially designed to rapidly evacuate air out of the Torresak™ plastic bag FIBC bag liner. In the embodiment illustrated by way of example only, it is 24" wide, and 18" deep, and is comprised of a 4½"×4" six sided angled expansion chamber at the top, and a 3" diameter short circular tube designed to fit an off-the-shelf shop vacuum hose. The nozzle narrows at the bottom to a ½"×24" opening. The opening is fitted with a series of ½" diameter tubes, projecting ¾" out from the bottom opening of the nozzle. The tubes prevent the walls of the Torresak™ plastic bag film liner from being sucked into the vacuum nozzle opening during operation. The velocity of air being drawn through the nozzle opening by the vacuum pump is reduced by the increased area of the expansion chamber, so that it becomes less than the settling velocity of the material being packed. This effect prevents particles from being drawn of the bag when the air is evacuated. The vacuum nozzle is fitted with a fixture for attaching a nitrogen hose, and also a pressure gauge.

A gas-fill sub-system of an example embodiment is also shown in FIG. 14. After the air is vacuumed from the bag, a valve placed at the proximal end of the nozzle is shut off so that the bag is stayed under vacuum. Then, the valve on the gas tank is turned on so that a fraction of the gas contained in the tank could flow into the porosity of the material contained in the bag via the connection port 1430, thereby replacing the evacuated air.

As noted above, the air is evacuated using a special, high volume, low velocity vacuum nozzle connected to a vacuum pump. The special shape of the vacuum nozzle 1410 removes the air from the inside of the plastic bag at a velocity lower than the settling velocity of the material being packed. This prevents the material from being sucked out of the plastic bag by the vacuum.

In accordance with the example embodiment illustrated, a valve/plumbing fitting is disposed on the low velocity nozzle for affixing a line to a source of the secondary gas, such as a nitrogen tank for example. The air is evacuated, then the secondary gas valve is opened thereby permitting secondary gas flush into the bag. The valve is then closed, and the bag vacuum sealed.

Preferably and in accordance with an example embodiment, one or more procedures are provided for settling the material placed in the bag to ensure maximum reduction in the porosity of the material being packed. This permits maximum loading of material in the bag, by reducing the air volume trapped in the porous spaces between the granules of the material being packed.

A first of the one or more procedures for settling the material placed in the bag to ensure maximum reduction in the porosity of the material being packed involves an initial filling of the bag with material, then pushing and pulling the bag, loaded in a cubic form to be described in greater detail below, mounted on a wheeled trolley, over a track consisting of a series of bumps, the vibration of which will cause the particles to settle, removing air space between the particles. Settling of the particles in this way will create space at the top of the bag, which will permit additional material to be loaded in the bag, to maximize the amount of material packed in the bag.

Another of the one or more procedures for settling the material placed in the bag to ensure maximum reduction in the porosity of the material being packed involves a powered vibration table that produces this same settling function, but perhaps at a somewhat greater cost than the method described herein.

Figure 15A:
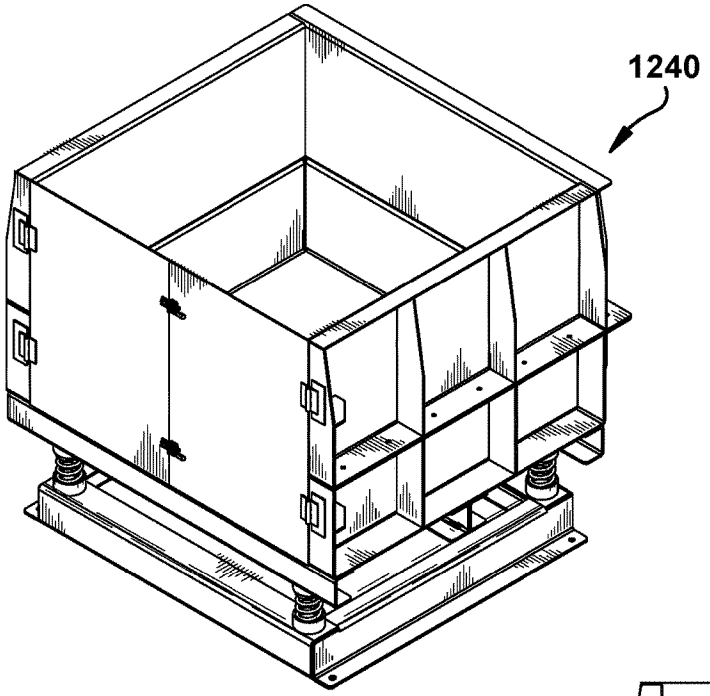
FIG. 15*a* is a perspective view of a vibratory form-shaping subsystem of an example embodiment.
Figure 15B:
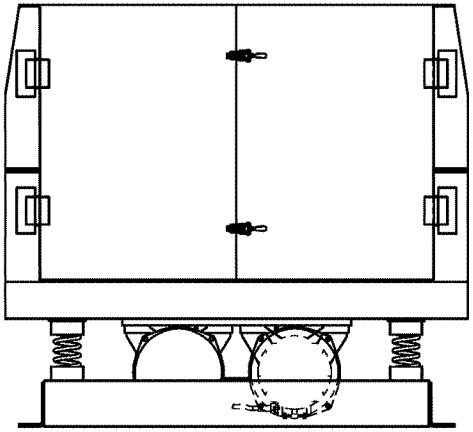
FIG. 15*b* is a front elevational view of the vibratory form-shaping subsystem of the example embodiment shown in FIG. 15*a;*
Figure 15C:
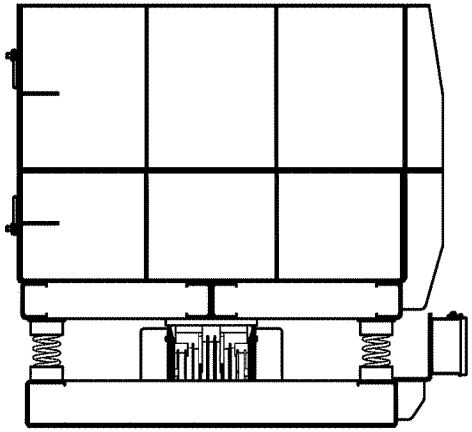
FIG. 15*c* is a right side elevational view of the vibratory form-shaping subsystem of the example embodiment shown in FIG. 15*a*.
Figure 15D:
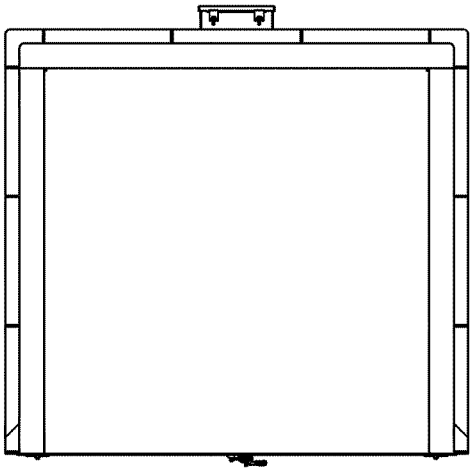
FIG. 15*d* is a top plan view of the vibratory form-shaping subsystem of the example embodiment shown in FIG. 15*a*.

A vibratory cubic form (mold) subsystem 1240 for the plastic bag in accordance with an example embodiment is shown in FIGS. 15*a*-15*c* and includes substantially cubic-shaped form member 1510, having inside dimensions substantially equal to the dimensions of the cubic shaped plastic bag contains the bag filled with material. The bottom 1520 of the cubic-form is partially open for forklift access to access, lift, and move away the filled bag after is sealed. The top 1522 of the cubic-form is also open such that the vacuum nozzle, hanging from the boom of the vacuum subsystem, can reach the spout of the plastic bag. The cubic-form has four vertically mounted sides; one of said sides is attached to the rest of the cubic form on hinges 1530; said side can then be open and closed, similar to a typical door. In its closed position, the form creates a substantially cubic shape for the plastic bag after is vacuumed, gas-filled, and sealed. To remove the sealed bag from the form, the hinged side is turned to open position; a forklift then could remove the sealed bag and transfer it to a storage location.

Described above are example embodiments. It is, of course, not possible to describe every conceivable combination of components or methodologies, but one of ordinary skill in the art will recognize that many further combinations and permutations of the example embodiments are possible. Accordingly, this application is intended to embrace all such alterations, modifications and variations that fall within the spirit and scope of the appended claims interpreted in accordance with the breadth to which they are fairly, legally and equitably entitled.

Having thus described the example embodiments, it is now claimed:

1. A composite bulk storage and transport apparatus comprising:

a flexible intermediate bulk container (FIBC) device comprising one or more side members and a bottom member, the one or more side members and the bottom member of the FIBC device defining an inner space of the FIBC device, and the one or more side members defining at least one aperture for allowing access to the inner space of the FIBC device through the one or more side members defining the at least one aperture;

an in-liner container comprising one or more side members and a bottom member, the one or more side members and the bottom member of the in-liner container defining an inner space of the in-liner container for receiving and holding an associated filled product, the in-liner container being received in the inner space of the FIBC device and comprising:

a multilayered composite film combination forming a bag defining a product fill opening, the multilayered composite film combination comprising:

a first polymer film having vacuum holding properties, the first polymer film acting as an inner layer of the in-liner container;

a second polymer film having vacuum holding properties, the second polymer film acting as an outer layer of the in-liner container; and a third polymer film disposed between the first and second polymer films, the third polymer film having oxygen barrier properties; and a plurality of sensor devices disposed in the inner space of the in-liner container received in the inner space of the FIBC device and located adjacent to the at least one aperture defined by the one or more side members of the FIBC device for viewing the plurality of sensor devices through the at least one aperture, the plurality of sensor devices sensing a level of a chemical in the inner space of the in-liner container and generating a signal representative of the sensed level of the chemical; wherein:

the one or more side members of the FIBC device comprise front and back panels and left and right gussets that together with the bottom member define the inner space of the FIBC device;

the at least one aperture comprises:

a first elongate vertical aperture defined between the back panel and the left gusset;

a second elongate vertical aperture defined between the left gusset and the front panel;

a third elongate aperture defined between the front panel and the right gusset; and a fourth elongate vertical aperture defined between the right gusset and the back panel; and the plurality of sensor devices comprise:

a first oxygen sensor device disposed in the inner space of the in-liner and located adjacent to the first elongate vertical aperture, the first oxygen sensor sensing a concentration of oxygen in the inner space of the in-liner container near to the first sensor and generating a first color signal representative of the sensed concentration of oxygen in the inner space of the in-liner container near to the first sensor;

a second oxygen sensor device disposed in the inner space of the in-liner and located adjacent to the second elongate vertical aperture, the second oxygen sensor sensing a concentration of oxygen in the inner space of the in-liner container near to the second sensor and generating a second color signal representative of the sensed concentration of oxygen in the inner space of the in-liner container near to the second sensor;

a third oxygen sensor device disposed in the inner space of the in-liner and located adjacent to the third elongate vertical aperture, the third oxygen sensor sensing a concentration of oxygen in the inner space of the in-liner container near to the third sensor and generating a third color signal representative of the sensed concentration of oxygen in the inner space of the in-liner container near to the third sensor;

a fourth oxygen sensor device disposed in the inner space of the in-liner and located adjacent to the fourth elongate vertical aperture, the fourth oxygen sensor sensing a concentration of oxygen in the inner space of the in-liner container near to the fourth sensor and generating a fourth color signal representative of the sensed concentration of oxygen in the inner space of the in-liner container near to the fourth sensor.

2. The apparatus according to claim 1, wherein:

each of the plurality of oxygen sensor devices comprises an adhesive attaching each of the plurality of oxygen sensor devices with the multilayered composite film combination in the inner space of the in-liner container.

3. The apparatus according to claim 2, wherein:

the first polymer film comprises a first low density polyethylene (LDPE) film;

the second polymer film comprises a second LDPE film; and the third polymer film comprises an ethylene-vinyl acetate (EVA) film.

4. The apparatus according to claim 3, wherein:

the first and second LDPE films provide an airtight vacuum seal; and the EVA film is impervious to a flow of oxygen therethrough.

5. The apparatus according to claim 4, wherein the EVA film is impervious to a flow of nitrogen therethrough.

6. The apparatus according to claim 3, wherein the multilayered composite film combination is a co-extrusion of the LDPE and EVA films.

7. The apparatus according to claim 3, wherein the LDPE and EVA films are in intimate contact with each other.

8. The apparatus according to claim 3, wherein the LDPE and EVA films are fused together as a single unitary film structure.

9. The apparatus according to claim 3, further comprising:

a first adhesive (ADH) film disposed between the first LDPE film and the EVA film, the first ADH film having bonding properties for connecting the first LDPE film with the EVA film; and a second ADH film disposed between the second LDPE film and the EVA film, the second ADH film having the bonding properties for connecting the second LDPE film with the EVA film.

10. The apparatus according to claim 3, further comprising:

a fill spout operatively coupled with the bag at the opening, the fill spout having a generally cylindrical conformation defining a first opening in fluid tight connection with the product fill opening of the bag, and a second opening configured to receive the associated filled product into the bag through the fill spout and the product fill opening; and a flexible bladder member carried on the fill spout adjacent to the second opening, the bladder member being configured to be selectively inflatable for selectively coupling the fill spout with an associated fill tube communicating the associated product, the bladder member being operative to couple the fill spout with the associated fill tube when the bladder is in an inflated condition and to decouple and release the fill spout from the associated fill tube when the bladder member is in a deflated condition.

11. A composite bulk storage and transport apparatus comprising:

a flexible intermediate bulk container (FIBC) device comprising one or more side members and a bottom member, the one or more side members and the bottom member of the FIBC device defining an inner space of the FIBC device, and the one or more side members defining at least one aperture for allowing access to the inner space of the FIBC device through the one or more side members defining the at least one aperture;

an in-liner container comprising one or more side members and a bottom member, the one or more side members and the bottom member of the in-liner container defining an inner space of the in-liner container for receiving and holding an associated filled product, the in-liner container being received in the inner space of the FIBC device and comprising:

a multilayered composite film combination forming a bag defining a product fill opening, the multilayered composite film combination comprising:

a first polymer film having vacuum holding properties, the first polymer film acting as an inner layer of the in-liner container;

a second polymer film having vacuum holding properties, the second polymer film acting as an outer layer of the in-liner container; and a third polymer film disposed between the first and second polymer films, the third polymer film having oxygen barrier properties; and a sensor device disposed in the inner space of the in-liner container received in the inner space of the FIBC device and located adjacent to the at least one aperture defined by the one or more side members of the FIBC device for viewing the sensor device through the at least one aperture, the sensor device sensing a level of a chemical in the inner space of the in-liner container and generating a signal representative of the sensed level of the chemical; wherein:

the one or more side members of the FIBC device comprise front and back panels and left and right gussets that together with the bottom member define the inner space of the FIBC device;

the at least one aperture comprises:

a first elongate vertical aperture defined between the back panel and the left gusset;

a second elongate vertical aperture defined between the left gusset and the front panel;

a third elongate vertical aperture defined between the front panel and the right gusset; and a fourth elongate vertical aperture defined between the right gusset and the back panel; and the (FIBC) device comprises:

a first fastener system for selectively closing the first elongate vertical aperture and tightening the back panel with the left gusset;

a second fastener system for selectively closing the second elongate vertical aperture defined between the left gusset and the front panel;

a third fastener system for selectively closing the third elongate vertical aperture and tightening the front panel with the right gusset; and a fourth fastener system for selectively closing the fourth elongate vertical aperture and tightening the right gusset with the back panel.

12. The apparatus according to claim 11, wherein:

the sensor device comprises an adhesive attaching the oxygen sensor device with the multilayered composite film combination in the inner space of the in-liner container.

13. The apparatus according to claim 12, wherein:

the first polymer film comprises a first low density polyethylene (LDPE) film;

the second polymer film comprises a second LDPE film; and the third polymer film comprises an ethylene-vinyl acetate (EVA) film.

14. The apparatus according to claim 13, wherein:

the first and second LDPE films provide an airtight vacuum seal; and the EVA film is impervious to a flow of oxygen therethrough.

15. The apparatus according to claim 14, wherein the EVA film is impervious to a flow of nitrogen therethrough.

16. The apparatus according to claim 13, wherein the multilayered composite film combination is a co-extrusion of the LDPE and EVA films.

17. The apparatus according to claim 13, wherein the LDPE and EVA films are in intimate contact with each other.

18. The apparatus according to claim 13, wherein the LDPE and EVA films are fused together as a single unitary film structure.

19. The apparatus according to claim 13, further comprising:

a first adhesive (ADH) film disposed between the first LDPE film and the EVA film, the first ADH film having bonding properties for connecting the first LDPE film with the EVA film; and a second ADH film disposed between the second LDPE film and the EVA film, the second ADH film having the bonding properties for connecting the second LDPE film with the EVA film.

20. The apparatus according to claim 13, further comprising:

a fill spout operatively coupled with the bag at the opening, the fill spout having a generally cylindrical conformation defining a first opening in fluid tight connection with the product fill opening of the bag, and a second opening configured to receive the associated filled product into the bag through the fill spout and the product fill opening; and a flexible bladder member carried on the fill spout adjacent to the second opening, the bladder member being configured to be selectively inflatable for selectively coupling the fill spout with an associated fill tube communicating the associated product, the bladder member being operative to couple the fill spout with the associated fill tube when the bladder is in an inflated condition and to decouple and release the fill spout from the associated fill tube when the bladder member is in a deflated condition.

* * * * *